US005831228A

United States Patent [19]

Kuki et al.

[11] Patent Number: 5,831,228

[45] Date of Patent: Nov. 3, 1998

[54] BREAKER DEVICE

[75] Inventors: Heiji Kuki; Kazumoto Konda; Tsutomu Tanaka; Kunihiko Watanabe, all of Yokkaichi, Japan

[73] Assignee: Sumitomo Wiring Systems, Ltd., Japan

[21] Appl. No.: 800,201

[22] Filed: Feb. 12, 1997

[30] Foreign Application Priority Data

| | | | |
|---|---|---|---|
| Feb. 15, 1996 | [JP] | Japan | 8-027801 |
| Mar. 29, 1996 | [JP] | Japan | 8-077133 |
| Apr. 17, 1996 | [JP] | Japan | 8-095736 |
| Nov. 4, 1996 | [JP] | Japan | 8-303358 |

[51] Int. Cl.[6] ..... H01H 15/00

[52] U.S. Cl. ..... 200/16 E; 200/404; 200/561

[58] Field of Search ..... 200/16 B, 16 E, 200/17 R, 43.01–43.22, 50.01, 50.11, 50.19, 243, 537, 554, 561, 401, 455

[56] References Cited

U.S. PATENT DOCUMENTS

| | | | |
|---|---|---|---|
| 3,872,269 | 3/1975 | Schneider | 200/441 |
| 3,967,081 | 6/1976 | Portmann et al. | 200/455 |
| 4,563,549 | 1/1986 | Lycan | 200/16 E |
| 4,639,558 | 1/1987 | Lycan | 200/16 E |
| 5,322,982 | 6/1994 | Leger et al. | 200/401 |

FOREIGN PATENT DOCUMENTS

| | | |
|---|---|---|
| 6-310227 | 11/1994 | Japan . |
| 6-327123 | 11/1994 | Japan . |

*Primary Examiner*—Khanh Dang
*Attorney, Agent, or Firm*—Anthony J. Casella; Gerald E. Hespos; Ludomir A. Budzyn

[57] ABSTRACT

A compact breaker device includes a pair of fixed electrodes 11*a*, 11*b* are placed upright at one side of the casing 1, and a fuse 12 is accommodated at the other side thereof. A movable electrode 31 including a pair of fittable terminals 32*a*, 32*b* connected with each other is mounted on a mount body 35. By engaging and disengaging the fittable terminals 32*a*, 32*b* with and from the fixed electrodes 11*a*, 11*b* through the ceiling wall of the casing 1, a breaker switch for connect and disconnect the fixed electrodes 11*a*, 11*b* is formed. The fuse 12 is connected in series with the breaker switch. A handle 40 is inclinably mounted on the upper surface of the mount body 35. The handle 40 is firmly held in a standing position and a resting position by a spring member 47 provided between it and the mount body 35. The handle 40 is inclined to the resting position when the breaker device is used, while being held upright when the breaker switch is turned on and off.

18 Claims, 29 Drawing Sheets

BREAKER DEVICE

BACKGROUND OF THE INVENTION

1. Field of the Invention

The present invention relates to a breaker device disposed in a power line, such as a power line of an electric automotive vehicle.

2. Description of the Prior Art

In a power line of an electric automotive vehicle, it is preferred that a breaker for interrupting the power line for maintenance or for other reasons be disposed together with a fuse for preventing a flow of an excessively large current. Accordingly, a knife switch type breaker and a container for housing the fuse have conventionally been disposed in the power line while being connected in series.

However, since a large current flows in the power line of the electric automotive vehicle, it is necessary to make both the knife-switch type breaker and the fuse container large, necessitating a large space to dispose them.

The breaker device according to the invention was developed in view of the above problem, and an object thereof is to compact the breaker device.

SUMMARY OF THE INVENTION

According to the invention, there is provided a breaker device, comprising: a pair of fixed electrodes; a movable electrode means engageable with and disengageable from the fixed electrodes for selectively connecting and disconnecting the fixed electrodes, thereby forming a breaker switch together with the fixed electrodes; and a handle provided at the movable electrode means for the engagement and disengagement of the movable electrode means.

According to a preferred embodiment of the invention, the handle is movably or pivotably or inclinably or rotatably provided at the movable electrode means.

The breaker device may further comprise a fuse connected in series with the breaker switch and preferably a casing. The pair of fixed electrodes may be placed substantially upright at or on one side of the casing, and the fuse may be accommodated in a remaining space of the casing.

Preferably, the handle is inclinable or pivotable between a resting position and a standing position arranged at an angle different from 0° or 180°, preferably substantially normal to the resting position, in particular toward the remaining space of the casing. The handle may be biased toward one or more positions by a toggle mechanism including a spring member. The handle may comprise at least one contact surface interacting with the spring member. The spring member may be made substantially made of a resilient plate (e.g. of spring steel) and having in particular at least one linear portion corresponding to the one or more positions of the handle.

The handle may comprise one or more contact surfaces interacting in sliding contact with a surface of the movable electrode means and the spring member may comprise a spring, preferably a helicoidal spring, biasing the handle toward the surface of the movable electrode means. The one or more contact surfaces of the handle preferably correspond to the one or more positions of the handle.

According to a further preferred embodiment, the breaker device further comprises an engagement detection means including in particular a proximity or lead switch, for detecting whether the breaker switch is correctly engaged or not, and in particular for producing an according detection control signal.

Most preferably, the movable electrode means comprises two or more fittable terminals that are fittable on or that are insertable in the fixed electrodes.

The breaker device may further comprises a slidable element and a guide slot provided between the handle and the casing. The guide slot may be adapted to guide a relative sliding movement of the slidable element, in particular as the handle is operated to engage and disengage the movable electrode with and from the fixed electrodes. When the handle is raised to its standing position and moved to insert the movable electrode, the insertion is effected with the handle held in its standing position while the slidable element is guided by the guide slot. Upon the completion of the proper engagement of the movable electrode with the fixed electrodes, the slidable element reaches an inclination permitting portion. Accordingly, the handle can be inclined by relatively displacing the slidable element.

The breaker device is excellent in safety because of its construction in which the conductive path is located within the casing and is, as a whole, compact because the handle is inclinable. Further, the handle will not wobble when it is held in its standing position and while it is being moved to engage the movable electrode with the fixed electrodes. Thus the engagement can be made smoothly. Furthermore, since the handle cannot be inclined unless the electrodes are properly engaged, thereby preventing the electrodes from being left insufficiently engaged.

Preferably, an inclination permitting portion is formed at the guide slot for permitting the handle to be inclined or pivoted, preferably by permitting the relative displacement of the slidable element upon the completion of the proper engagement or fitting and/or insertion of the movable electrode with the fixed electrodes.

The slidable element may be provided at the handle and preferably is distanced from an axis of inclination of the handle.

If the handle is inclined while the slidable element is fitted in the guide slot, the slidable element is wrenched in the guide slot. However, a force which will act on the slidable element can be suppressed since the slidable element is distanced from the axis of inclination, thereby preventing an occurrence of a damage.

A length of the slidable element along a direction of insertion of the slidable element into the guide slot may be substantially larger than a width of the guide slot in a direction at an angle different from 0° or 180° with respect to the direction of insertion of the slidable element, in particular along a direction of inclination of the handle in its resting position.

According to still a further preferred embodiment of the invention, the breaker device further comprises a movable member which is so provided between the handle and the movable electrode as to be movable between an inclination prohibiting position, where it uninclinably locks the handle and an inclination permitting position where it permits the inclination of the handle.

When the handle is raised to its standing position and moved for the engagement of the movable electrode, the engagement is made while the handle is held in its standing position with the movable member biased toward the inclination prohibiting position. When the movable electrode is properly engaged with the fixed electrodes, the operable member moves the movable member to the inclination permitting position, in particular against the biasing force, enabling the inclination of the handle.

The above breaker device is excellent in safety because of its construction in which the conductive path is located within the casing and is, as a whole, compact because the handle is inclinable. Further, since the handle is held in its standing position, i.e. the handle does not wobble while being moved to engage the movable electrode with the fixed electrodes, the engagement can be made smoothly. Furthermore, since the handle cannot be inclined unless the electrodes are properly engaged, it prevents the electrodes from being left insufficiently engaged.

Preferably, the breaker device further comprises a biasing member for constantly biasing the movable member toward the inclination prohibiting position and/or an operable member, in particular provided at the casing, for coming into engagement with the movable member while the movable electrode is being engaged and for moving the movable member to the inclination permitting position when the movable electrode is properly engaged with the fixed electrodes.

Still further preferably, the handle is inclinably supported with respect to at least two shafts which are substantially coaxially alignable. One shaft may be displaceable between a displacement position where the axis thereof is displaced from that of the other shaft and an alignment position where the axis thereof is aligned with that of the other shaft. The shafts preferably are biased constantly toward the displacement position by the biasing member. The casing may be provided with an operable member for coming into engagement with the one shaft, while the movable electrode is being engaged. The operable member may move the one shaft to the alignment position when the movable electrode is properly engaged with the fixed electrodes.

When the handle is raised to its standing position and moved for the engagement of the movable electrode, the engagement is made while the handle is held in its standing position and with the one shaft displaced from the other shaft. When the movable electrode is properly engaged with the fixed electrodes, the one shaft is coaxially aligned with the other shaft by the operable member, thereby enabling the inclination of the handle.

A slidable element and a guide slot for guiding only a relative sliding movement of the slidable element may be provided between the handle and the movable electrode. The guide slot may be formed with an inclination permitting portion for permitting the inclination of the handle by permitting a relative displacement of the slidable element. The slidable element preferably is biased constantly toward a position spaced apart from the inclination permitting portion by a biasing member. Preferably the casing is provided with an operable member for coming into engagement with the slidable element while the movable electrode is being engaged, and for moving the slidable element to the position of the inclination permitting portion of the guide slot, when the movable electrode is properly engaged with the fixed electrodes.

The breaker device may further comprise a current interrupting means for interrupting the current flowing to the fixed electrodes before the movable electrode is disengaged. The current interrupting means may function in any position of the handle except its resting position.

Preferably, the breaker device further comprises a disengagement preventing means for preventing a disengagement of the movable electrode from the fixed electrodes when there is a current flowing to the fixed electrodes and/or a voltage or electrical tension applied thereto. It is therefore avoided that the movable electrodes are disengaged from the fixed electrodes when a current is flowing therethrough, therefore enhancing the security of the breaker device. Moreover also if the current interrupting means fails to work, due to the disengagement preventing means the movable electrode cannot be disengaged, thus providing for a fail-safe system.

According to a preferred embodiment of the invention, there is provided a breaker device, comprising a casing with a pair of fixed electrodes placed upright at one side of the casing. A movable electrode is engageable with and disengageable from the leading ends of the fixed electrodes to connect and disconnect the fixed electrodes, thereby forming a breaker switch together with the fixed electrodes. An inclinable handle is provided at the movable electrode for the engagement and disengagement of the movable electrode. A fuse accommodated in a remaining space of the casing is connected in series with the breaker switch.

When the movable electrode is engaged with the fixed electrodes, an electric path is brought into a conductive state via the fuse. In the conductive state, the handle can be held inclined. When the handle is raised and pulled up, the movable electrode is disengaged from the fixed electrodes, thereby turning the breaker switch of f and interrupting the electric path. The fuse is exchanged after the breaker switch is turned off by pulling up the handle in a similar manner.

Since the breaker switch and the fuse are arranged in the casing and the handle is inclinable, the breaker device is advantageously allowed to have a compact configuration having a short height. Preferably, the handle is inclinable toward the remaining space of the casing. Since the handle is inclined toward the remaining space of the casing, it does not bulge from the side surface of the casing and the breaker device is allowed to have a compact configuration. Further preferably, the handle can be held in a standing position and a resting position by a toggle mechanism including a spring member.

Since the handle is held in its resting position in the conductive state, it does not wobble even upon being subjected to a vibration while the vehicle is running, thereby preventing generation of unusual noises. Further, since the handle can also be held in its standing position, the movable electrode does not wobble when being engaged with and disengaged from the fixed electrodes by gripping the handle. Thus, the engagement and disengagement of the electrodes can be smoothly done.

These and other objects, features and advantages of the present invention will become more apparent upon a reading of the following detailed description and accompanying drawings.

DETAILED DESCRIPTION OF THE PREFERRED EMBODIMENTS

Figure 1:
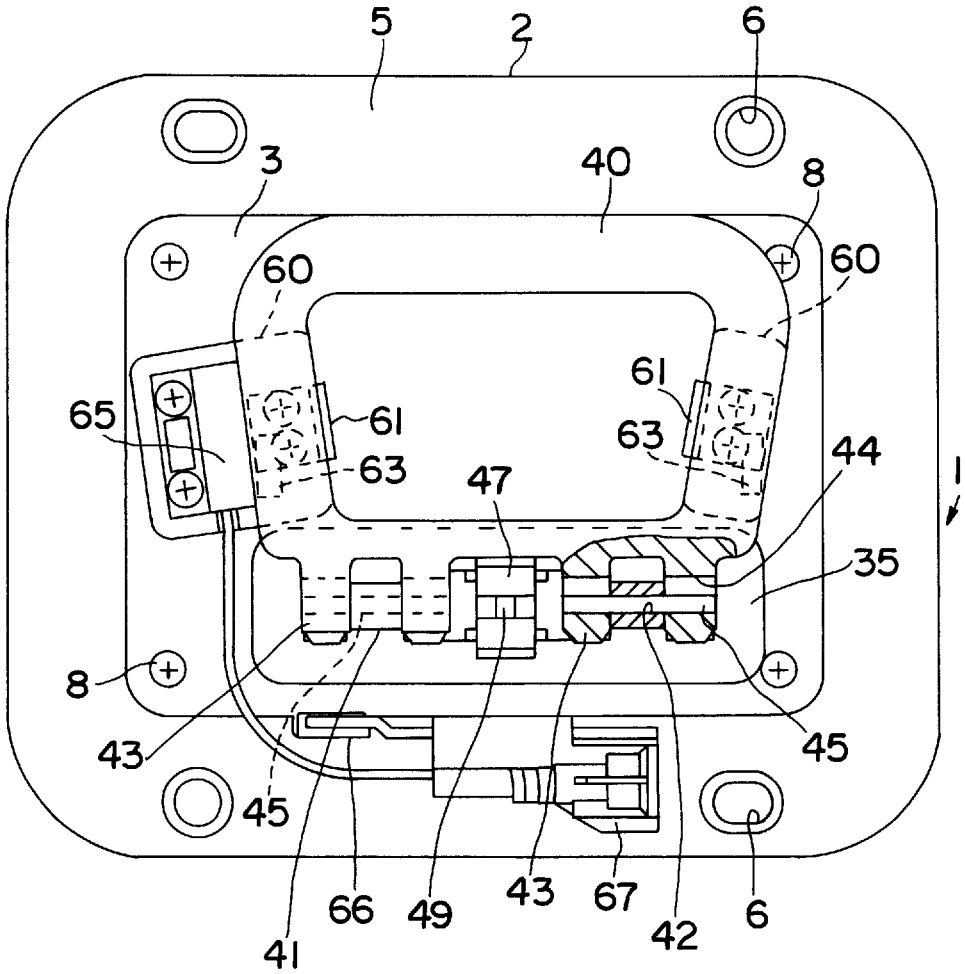
FIG. 1 is a plan view of a first embodiment of the invention when a handle is in its resting position.
Figure 2:
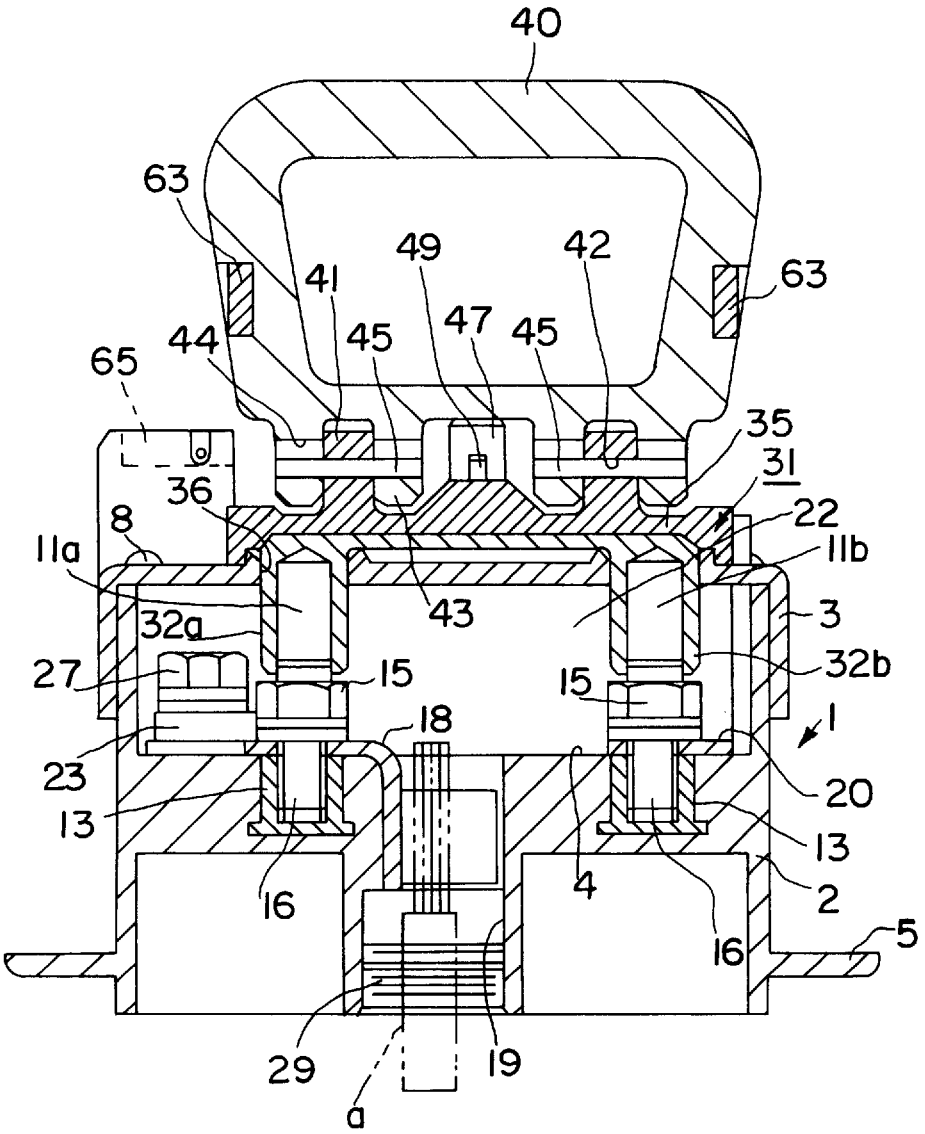
FIG. 2 is a vertical section of the first embodiment when the handle is in its standing position.
Figure 3:
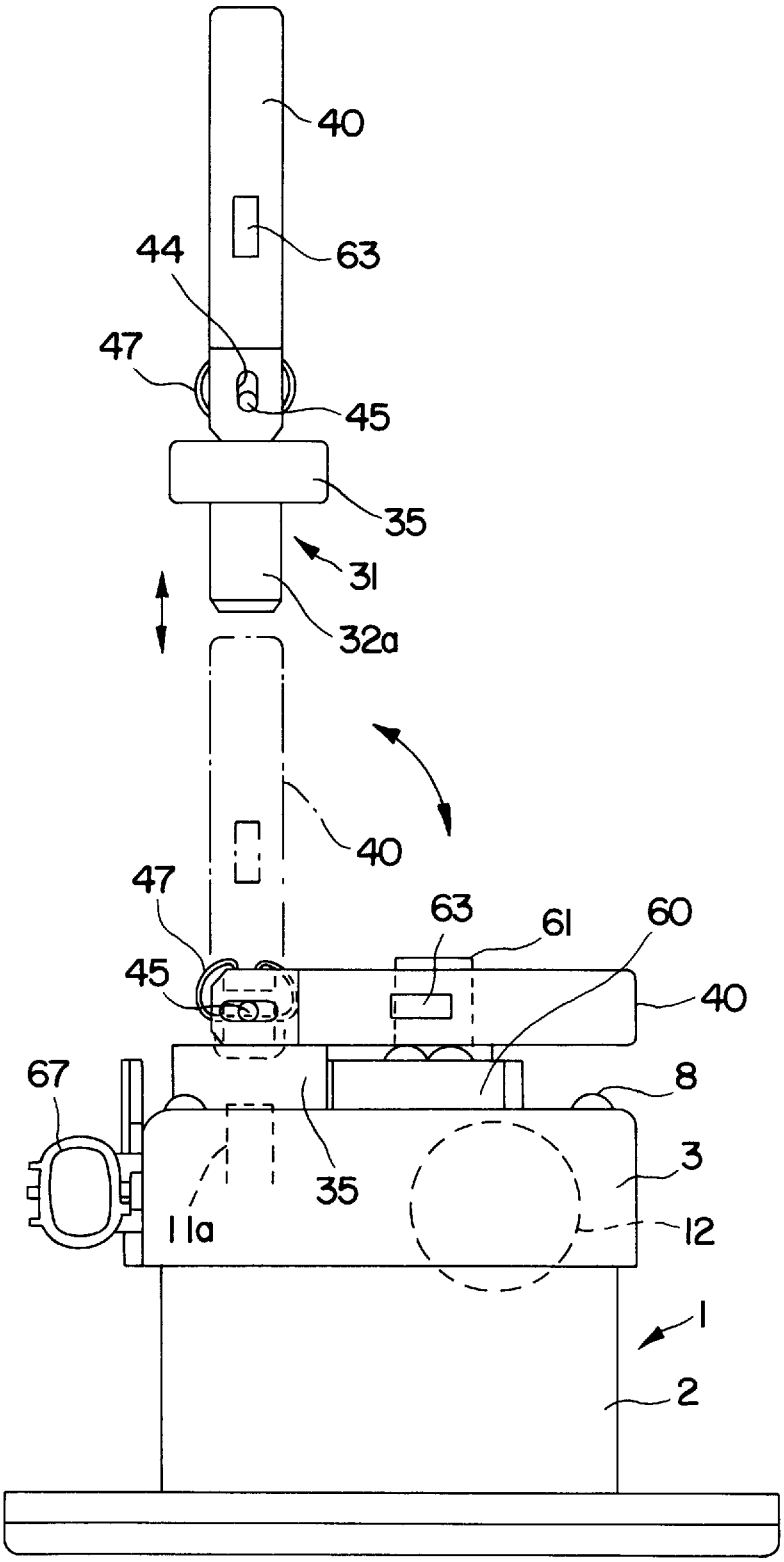
FIG. 3 is a side view showing how the handle is used for the engagement and disengagement of electrodes.

FIGS. 1 to 8 show a first embodiment of the invention. In FIGS. 1 to 3, a casing 1 made e.g. of synthetic resin includes upper and lower casings 2 and 3. The lower casing 2 is in the form of a bottomed tube having a substantially rectangular cross section, and its bottom wall 4 is located substantially in the middle of its height. Further, a mount flange 5 is formed around the outer surface of the bottom end of the lower casing 2. This flange 5 is mounted on an unillustrated vehicle body by fastening screws through mount holes 6 formed in its four corners.

The upper casing 3 is formed into a lid-like shape to be fitted to the upper end of the lower casing 2. The upper casing 3 is detachably fitted to the lower casing 2 by fastening screws 8 inserted through insertion holes formed in four corners of its upper surface into screw holes 9 (see FIG. 4) formed in four corners of the upper end surface of the lower casing 2.

In the lower casing 2, a pair of fixed electrodes 11*a*, 11*b* are placed upright at one side (front side in FIG. 4) , and a fuse 12 is accommodated at the other side. In order to stand the fixed electrodes 11*a*, 11*b*, a pair of internally threaded members 13 are buried in the bottom wall 4 at a specified interval e.g. by insert molding as shown in FIG. 2 or by press fit. Each of the fixed electrodes 11*a*, 11*b* is in the form of a pin formed with a hexagonal portion 15 in its longitudinal center and with an externally threaded portion 16 at its bottom end portion. In other words, the respective electrodes 11*a*, 11*b* can stand by spirally fitting at least part of the externally threaded portions 16 with the corresponding internally threaded members 13.

Figure 5:
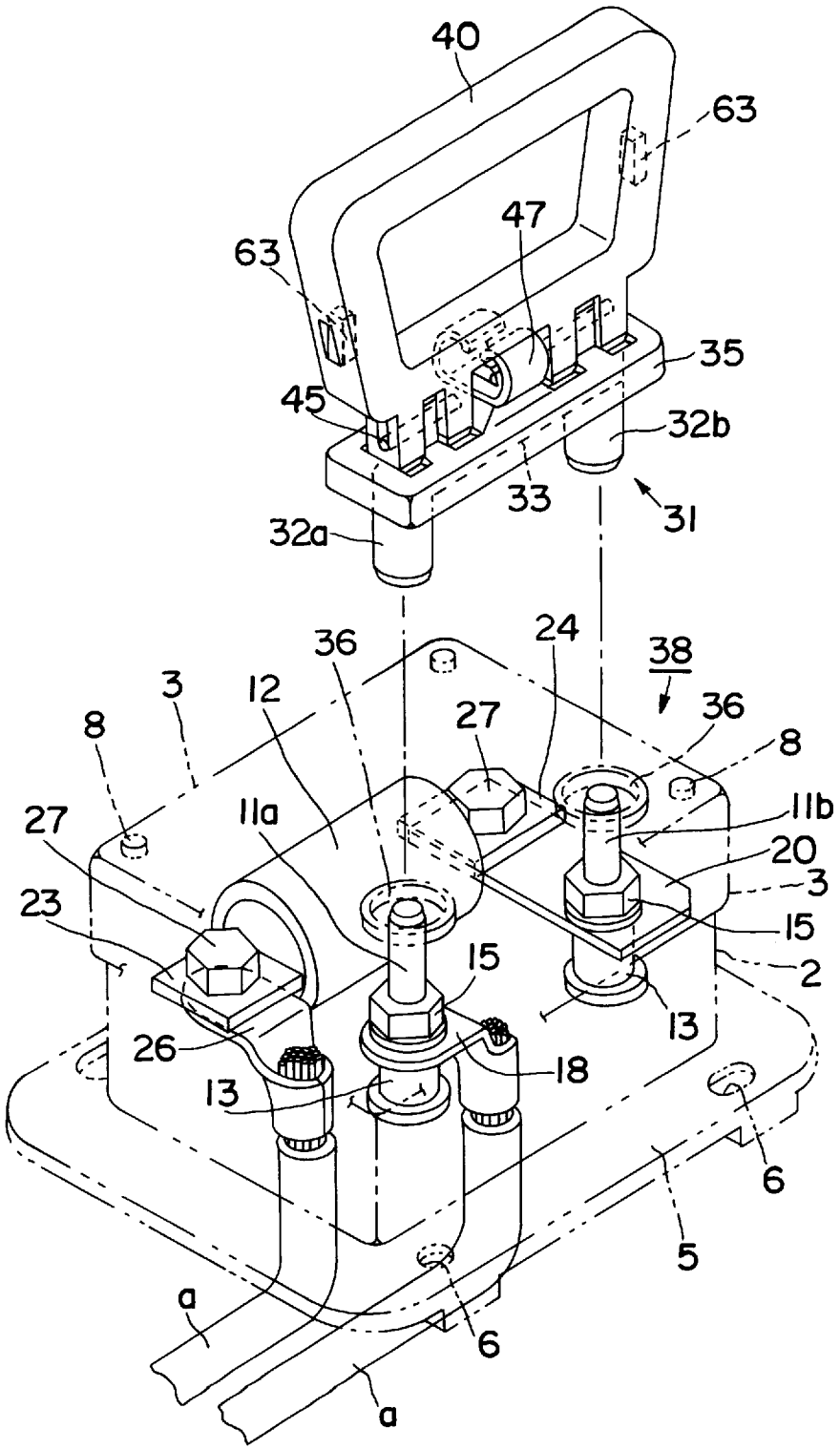
FIG. 5 is a perspective view showing the interior construction of the casing and the construction of a mount body.

As also shown in FIG. 5, a terminal fitting 18 connected with one cut end of a wire "a" is secured to one fixed electrode 11*a* (left one in FIG. 2). This part of the wire "a" is drawn out through a first insertion hole 19 formed in the bottom wall 4. Further, a busbar 20, connected with one end of a fuse 12 to be described later, is secured to the other fixed electrode 11*b*.

Figure 4:
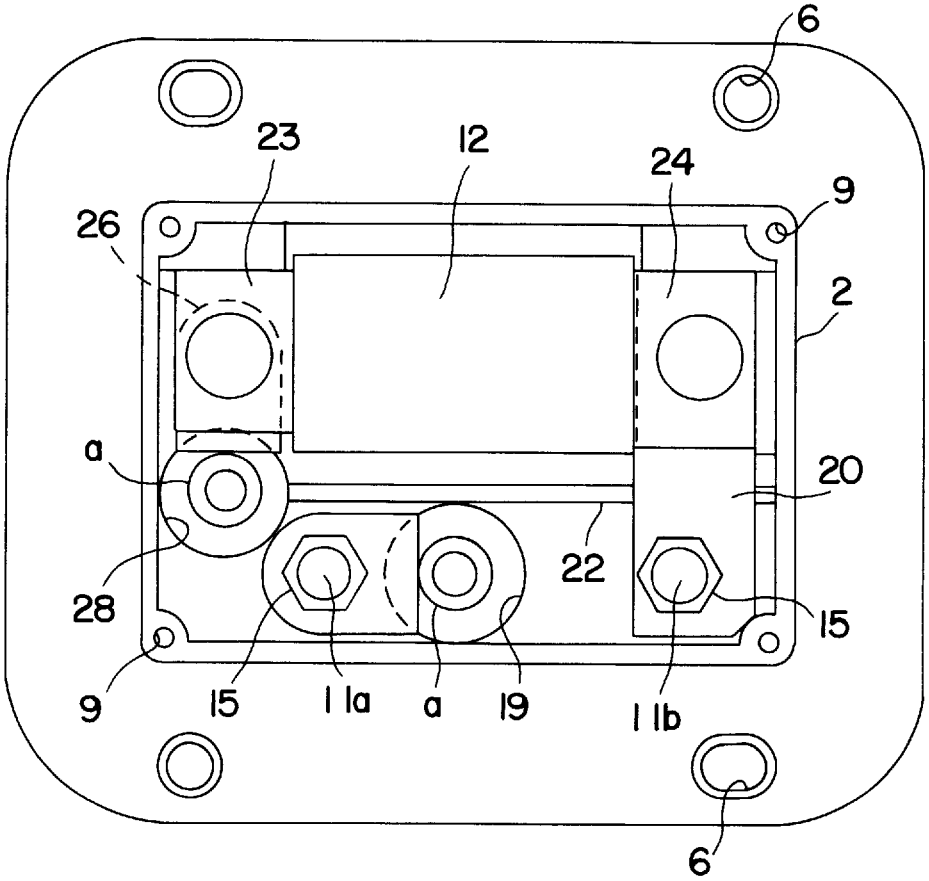
FIG. 4 is a plan view showing the interior construction of a casing.

The fuse 12 is accommodated at the other side of the bottom wall 4 of the lower casing 2, and a partition wall 22 projects from the bottom wall 4 between the fuse 12 and the fixed electrodes 11*a*, 11*b* (see FIG. 4). Connection members 23, 24 project from the opposite ends of the fuse 12. One connection member 23 is secured to a terminal fitting 26 connected with the other cut end of the wire "a" by fastening a bolt 27. This part of the wire "a" is drawn through a second insertion hole 28 formed in the bottom wall 4. Waterproof plugs 29 mounted on the wire "a" are fitted into the insertion holes 19, 28 to seal the openings. To the other connection member 24 of the fuse 12 is secured one end of the horizontally extending busbar 20 by another bolt 27. The other end of the busbar 20 is secured to the fixed electrode 11*b* as described above.

A movable electrode 31 is detachably engageable with the pair of fixed electrodes 11*a*, 11*b*. As shown in FIG. 2, the movable electrode 31 is constructed such that a bridging member 33 is bridged between a pair of louver or insertable or plug-in or fittable terminals 32*a*, 32*b* being in particular at least partly hollow and engageable with the leading ends of the respective fixed electrodes 11*a*, 11*b* so as to mechanically and/or electrically connect the fittable terminals 32*a*, 32*b*. The movable electrode 31 is formed by mounting the respective fittable terminals 32*a*, 32*b* on a narrow mount body 35 of insulating material e.g. synthetic resin by insert molding such that the terminals 32*a*, 32*b* project from the bottom surface of the mount body 35.

On the other hand, a pair of insertion holes 36 into which the fittable terminals 32*a*, 32*b* of the movable electrode 31 are insertable are formed in positions of the ceiling wall of the upper casing 3 right above the fixed electrodes 11*a*, 11*b*. More specifically, the fittable terminals 32*a*, 32*b* of the movable electrode 31 are engageable with, i.e. engaged with and disengaged from the corresponding fixed electrodes 11*a*, 11*b* within the casing 1 through the insertion holes 36, thereby forming a breaker switch 38 for connecting and disconnecting the fixed electrodes 11*a*, 11*b*. The fuse 12 is disposed in an intermediate position of the wire "a" while being connected in series with the breaker switch 38.

A handle 40 used to engage and disengage the movable electrode 31 is provided at the upper surface of the mount body 35. The handle 40 is in the form of a frame having, in particular, an outer shape of a reverse trapezoid. Bearing portions 41 formed with bearing holes 42 project at the opposite ends of the upper surface of the mount body 35 with respect to its longitudinal direction. Further, a pair of bearing portions 43 forked to hold the bearing portions 41 and formed with bearing holes 44 project at the edge of the mount side of the handle 40. The bearing hole 44 of each bearing portion 43 of the handle 40 is a narrow oblong hole which is wide in the projection direction of the bearing portion 43.

The bearing portions 41 of the mount body 35 are fitted into recesses of the corresponding forked bearing portion 43 of the handle 40. By inserting one or more support shafts 45 through the bearing holes 42, 44 of the bearing portions 41, 43, the handle 40 is mounted on the upper surface of the mount body 35, pivotally about the support shafts 45.

The handle 40 can be held in a standing position where it stands upright at the opposite side of or flushing with the fittable terminals 32*a*, 32*b* (see phantom line position of FIG. 3) and in a resting position where it lies in a direction arranged at an angle different from 0° or 180°, in particular substantially normal to the projection direction of the fittable terminals 32*a*, 32*b*. To this end, a spring member 47 as shown in FIG. 6 is mounted between the mount body 35 and the handle 40.

Figure 6:
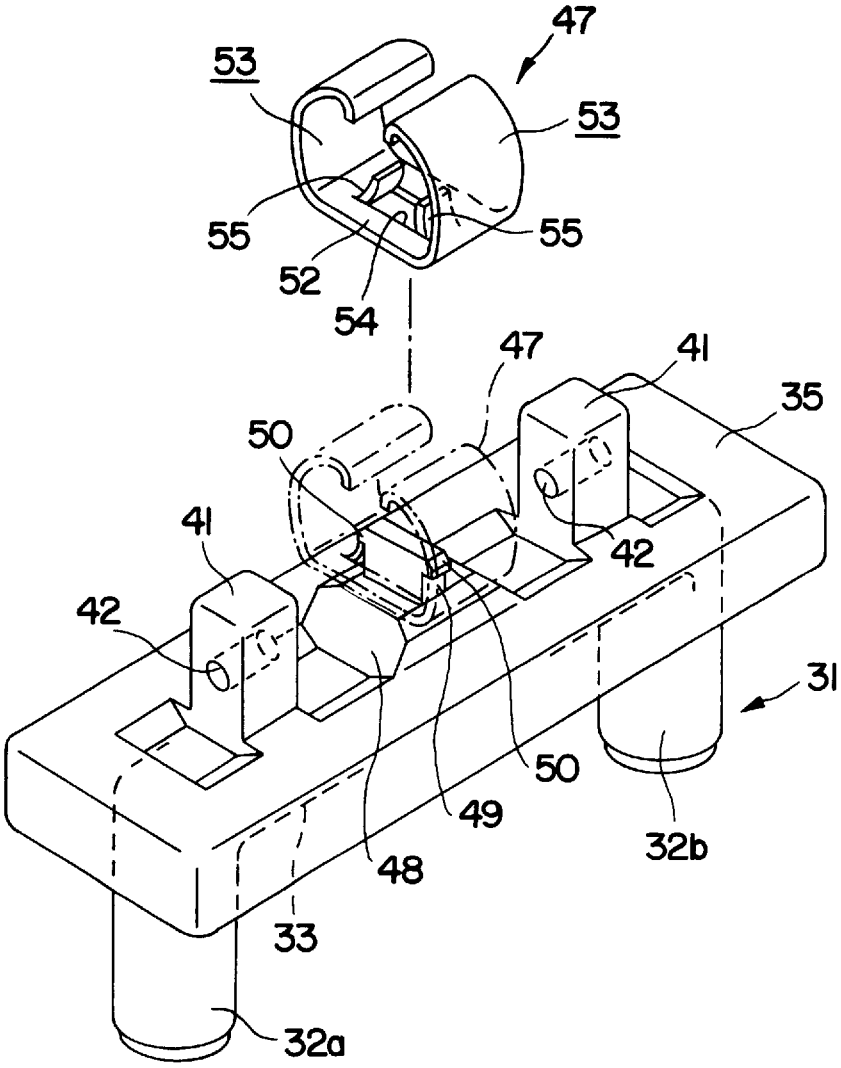
FIG. 6 is a perspective view showing the construction of a portion where a spring member is mounted.
Figure 7:
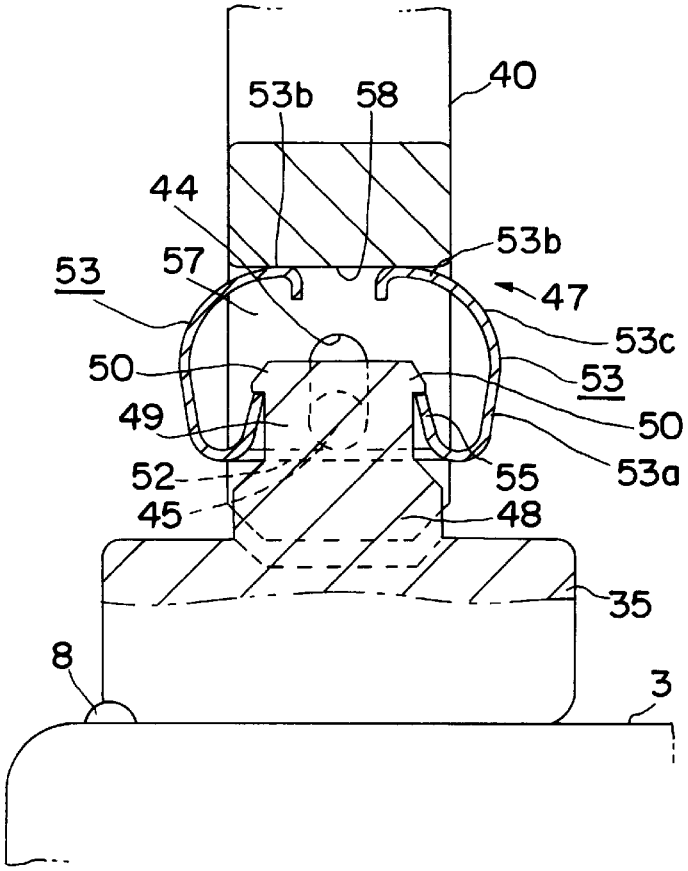
FIG. 7 is an enlarged vertical section of the first embodiment when the handle is in its standing position.
Figure 8:
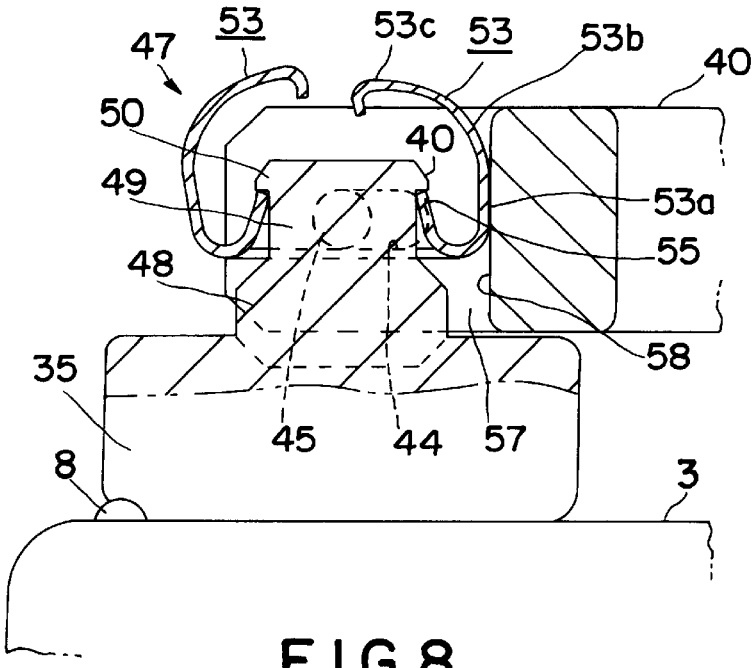
FIG. 8 is an enlarged vertical section of the first embodiment when the handle is in its resting position.

As shown in FIGS. 6 to 8, a projected portion 48 is formed approximately in the longitudinal center of the upper surface of the mount body 35, and a mount projection 49 in the form of a narrow substantially rectangular column extending in a direction substantially normal to the longitudinal direction of the mount body 35 projects from the top surface of the projected portion 48. Hooks or projections 50 project from the opposite shorter sides of the upper end of the mount projection 49.

The spring member 47 is made by pressing a resilient material e.g. a spring steel plate, and formed such that inwardly bent portions 53 are symmetrically formed at the opposite ends of a strip-like base plate 52. In the center of the base plate 52, there is formed a rectangular engaging hole 54 adapted or fittable to the mount projection 49, and engaging portions 55 are formed by bending at the opposite shorter ends of the engaging hole 54. In other words, the spring member 47 is disengageably and unrotatably mounted by fitting the engaging hole 54 with the mount projection 49 while arranging the base plate 52 and the mount body 35 such that they extend in substantially orthogonal directions until the base plate 52 is pressed against the projected portion 48 as shown in FIG. 7, and by engaging the leading ends of the engaging portions 55 with the hooks 50 of the mount projection 49.

On the other hand, in the center of the outer surface of the mount side edge of the handle 40, there is formed a recess 57 forming a space for accommodating the spring member 47 mounted on the mount body 35. The bottom surface of the recess 57 acts as a contact surface 58 with which the bent portions 53 of the spring member 47 come into contact. Specifically, each bent portion 53 of the spring member 47 is such that a substantially linear portion 53*a* of a specified length extends at an angle different form 0° or 180°, particularly upward substantially along the vertical direction from the end of the base plate 52 via a slightly curved portion. An arcuate portion 53*c* extends from the leading end of the linear portion 53*a* to a position slightly inward of the leading end of the engaging portion 55. A substantially linear portion 53*b* extends substantially along the horizontal direction from the leading end of the arcuate portion 53*c*. The leading end of each bent portion 53 is bent at an angle, particularly downward substantially at right angles.

The handle 40 is pivotable about the support shafts 45 by bringing the bent portion 53 of the spring member 47 into contact with the contact surface 58 and causing it to elastically contract. Upon being subjected to an elastic restoring force of the bent portion 53, a force to move the handle 40 outward is biased, and each support shaft 45 comes into contact with one end of the corresponding long bearing hole 44, with the result that the movement of the handle 40 is restricted. A distance between the support shaft 45 and the arcuate portion 53*c* of the spring member 47 are longer than distances between the support shaft 45 and the linear portions 53*a*, 53*b* at the base and leading ends of the spring member 47. Thus, when the handle 40 is pivoted while the contact surface 58 is in sliding contact with the bent portion 53, an amount of deformation of the bent portion 53 is larger and accordingly an opposing force is larger when the contact surface 58 is in contact with the arcuate portion 53*c*. Further, the arcuate portion 53*c* has a smaller contact area with the contact surface 58. Therefore, while the contact surface 58 is sliding in contact with the arcuate portion 53*c*, the handle 40 tries to move toward the linear portion 53*a* or 53*b* having a smaller opposing force . Thus the handle 40 is biased either toward a substantially standing position, where the contact surface 58 is in contact with the linear portion 53*b*, or toward at least one resting or angled or laying position, where the contact portion 58 is in contact with the linear portion 53*a* or one of the linear portions 53*a*.

Alternatively (not shown) the handle 40 can be biased toward at least one predetermined or predeterminable position by a helicoidal spring acting on the handle 40 to bring a contact surface thereof in sliding contact with a surface of the mount body 35, wherein the contact surface of the handle 40 comprises at least one substantially linear portion corresponding or defining to the at least one position.

When the contact surface 58 is in contact with the linear portion 53*a* or 53*b*, the handle 40 does not try to move toward the arcuate portion 53*c* since the opposing force of the linear portion 53*a* or 53*b* is relatively smaller. Further, since the linear portion 53*a* or 53*b* is in contact with the contact surface 58 over a wide area, the handle 40 is stably held. In other words, upon being subjected to a kind of toggle action, the handle 40 is stably held in the standing position where it stands upright at the opposite side of the projection direction of the fittable terminals 32*a*, 32*b* and in the resting position where it lies in the direction at an angle, particularly normal to the projection direction of the fittable terminals 32*a*, 32*b*.

In positions of the ceiling surface of the upper casing 3 corresponding to the accommodated fuse 12, support tables 60 are provided as shown in FIGS. 1 and 3. An L-shaped receiving member 61 is mounted on each support table 60. The receiving members 61 receive the substantially center portions of the opposite side portions of the handle 40 when the movable electrode 31 is properly engaged with the fixed electrodes 11*a*, 11*b* and the handle 40 is inclined to or positioned in its resting position.

Magnets 63 are mounted in symmetrical positions of the outer surfaces of the opposite side portions of the hand 40. On the other hand, a lead switch 65 is mounted on the ceiling surface of the upper casing 3. The lead switch 65 is so disposed as to be located right before one of the magnets 63 when the movable electrode 31 is properly engaged with the fixed electrodes 11*a*, 11*b* and the handle 40 is inclined to its resisting position as described above, and outputs a detection signal when the magnet 63 comes right before it. The lead switch 65 is connected with an unillustrated computer for performing necessary controls via a connector 67 mounted by a bracket 66 at one side surface of the upper casing 3.

This embodiment is constructed as described above, and the operation thereof is described hereafter.

The pair of fixed electrodes 11*a*, 11*b* are placed upright and the fuse 12 is accommodated in the casing 1, and connected in a manner as described above between the cut ends of the wire "a". In order to bring the wire "a" into its conductive state, the handle 40 is raised to its standing position outside the casing 1. Then, as shown in FIG. 7, the contact surface 58 of the handle 40 is brought into contact with the linear portions 53*b* at the leading ends of the bent portions 53 of the spring member 47, and the handle 40 is stably held in its standing position by the toggle action as described above.

Subsequently, the handle 40 is gripped to insert the fittable terminals 32*a*, 32*b* of the movable electrode 31 projecting from the mount body 35 into the insertion holes 36 of the upper casing. Since the handle 40 is relatively firmly held onto the mount body 35, the mount body 35 or the movable electrode 31 does not wobble. Accordingly, the fittable terminals 32*a*, 32*b* can be smoothly inserted into the insertion holes 36.

When the fittable terminals 32*a*, 32*b* of the movable electrode 31 are engaged with the corresponding fixed electrodes 11*a*, 11*b*, the breaker switch 38 is turned on, with the result that the wire "a" is brought into the conductive state, i.e. via the terminal fitting 26, the connection member 23, the fuse 12, the connection member 24, the busbar 20, the fixed electrode 11*b*, the fittable terminal 32*b*, the bridging member 33, the fittable terminal 32*a*, the fixed electrode 11*a* and the terminal fitting 18, thereby putting the breaker device to use. In this used state, the handle 40 standing upright is inclined toward the support tables 60. When the handle 40 is inclined such that the contact surface 58 comes into contact with the arcuate portion 53c of one bent portion 53 of the spring member 47, the contact surface 58 is subjected to a relatively large resistance. When the handle 40 is further inclined such that the contact surface 58 comes into contact with the linear portion 53*a*, the resistance becomes smaller. The handle 40 is consequently inclined to the resting position as indicated by solid line in FIG. 3 where it rests on the receiving members 61 of the support tables 60.

In the resting position, as shown in FIG. 8, the contact surface 58 of the handle 40 is in contact with the linear portion 53*a* at the base end of the one bent portion 53 of the spring member 47 and, accordingly, the handle 40 is stably held in the resting position by the aforementioned toggle action. Thus, the handle 40 does not wobble even upon being subjected to a vibration or the like while the vehicle is running, thereby preventing generation of unusual noises.

If the movable electrode 31 is properly engaged with the fixed electrodes 11*a*, 11*b* as described above, one of the magnets 63 provided at the handle 40 is located right before the lead switch 65 when the handle 40 is inclined to the resting position. Accordingly, the lead switch 65 outputs the detection signal, thereby detecting that the breaker switch 38 has been turned on. On the other hand, if the movable electrode 31 is insufficiently engaged, the magnet 63 cannot be located right before the lead switch 65 even if the handle 40 is inclined to the resting position and, therefore, no detection signal is obtainable. As a result, erroneous insertion can be detected.

When the breaker switch 38 is turned off for maintenance, the handle 40 is raised from the position indicated by solid line in FIG. 3. The handle 40 is raised while being subjected to a relatively large resistance at an intermediate stage and, when the resistance becomes smaller, reaches the standing position as indicated by phantom line in FIG. 3 where it is stably held. Thereafter, if the handle 40 is gripped and pulled up, the movable electrode 31 is disengaged from the fixed electrodes 11*a*, 11*b*, thereby turning the breaker switch 38 off and bringing the wire "a" into a nonconductive state.

When the fuse 12 blows out, the breaker switch 38 is turned off by withdrawing the movable electrode 31 in a similar manner, and the screws 8 are loosened to remove the upper casing 3. Since the fuse 12 is exposed in this state, the fuse 12 is removed by loosening the bolts 27 and replaced with a new one. Because the breaker switch 38 is already turned off, the fuse 12 can be safely exchanged.

As described above, in the breaker device according to this embodiment, the breaker switch 38 and the fuse 12 are arranged in the casing 1, and the operation handle 40 can be inclined. Accordingly, the breaker device is allowed to have a compact configuration having a short height. Further, if the handle 40 is inclined along the upper surface of the upper casing 3 as in the foregoing embodiment, it does not bulge from the side surface of the casing 1. Thus, the handle 40 is not erroneously caught.

Since the handle 40 is stably held in the resting position in the used state by the toggle action as described above, the handle 40 does not wobble even upon being subjected to a vibration while the vehicle is running and, hence, does not generate unusual noises. Further, the breaker switch 38 is turned on and off while holding the handle 40 in its standing position. Since the handle 40 is stably mounted on the mount body 35 even in its standing position, the movable electrode 31 does not wobble when it is engaged with and disengaged from the fixed electrodes 11*a*, 11*b* while gripping the handle 40. Thus, the movable electrode 31 can be smoothly and efficiently engaged with and disengaged from the fixed electrodes 11*a*, 11*b*.

Figure 9:
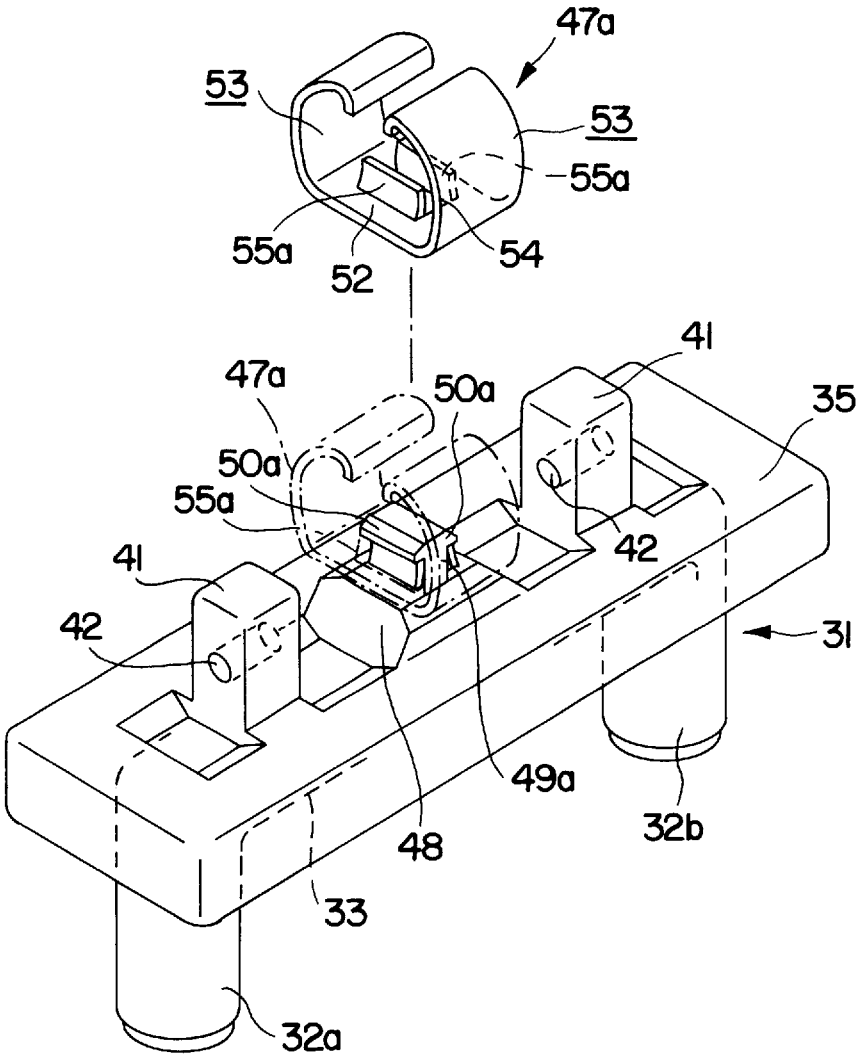
FIG. 9 is a perspective view showing the construction of a portion where a spring member according to a second embodiment of the invention is mounted.
Figure 10:
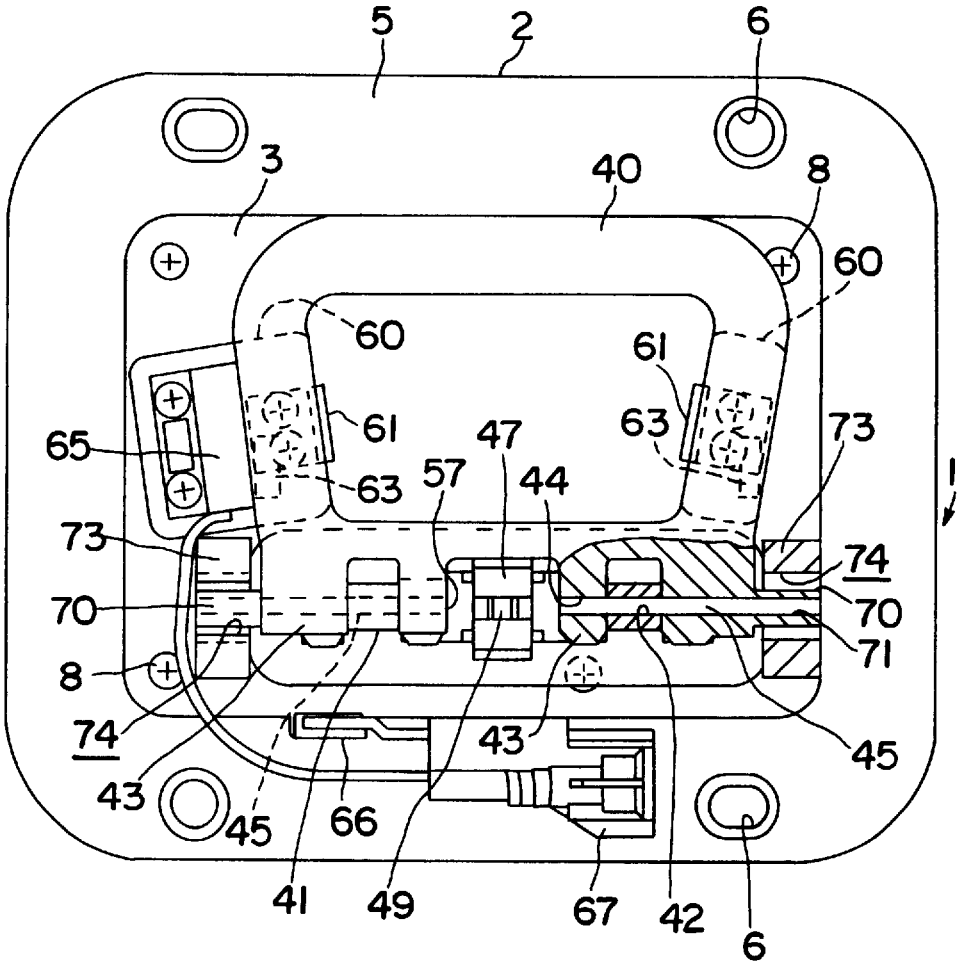
FIG. 10 is a plan view of a third embodiment of the invention when a handle is in its resting position.
Figure 11:
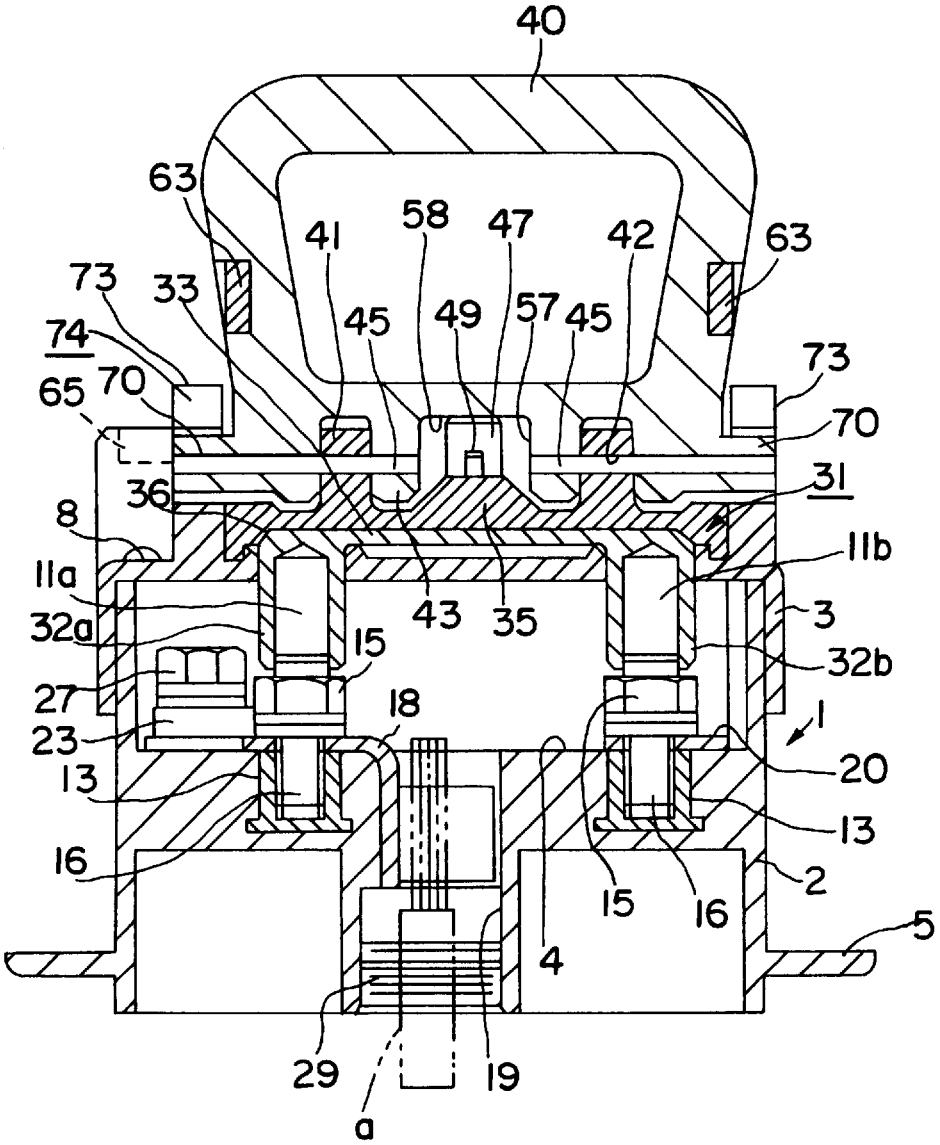
FIG. 11 is a vertical section of the third embodiment when the handle is in its standing position.

FIG. 9 shows a second embodiment of the invention. In this embodiment, a construction for mounting a spring member 47*a* on a mount projection 49*a* projecting from the mount body 35 is different than in the previous embodiment.

In the spring member 47*a*, a pair of engaging portions 55*a* are formed by bending parts of the base plate 52 at longer sides of an engaging hole 54 formed in the base plate 52. In other words, the engaging portions 55*a* extend in a direction substantially normal to the deformation direction of the bent portions 53. On the other hand, at the mount projection 49*a*, engaging hooks 50*a* project from the longer sides of the upper end so as to conform to the bent portions 55*a*.

The other construction is identical or similar to that of the first embodiment and, accordingly, no repeated description is given by identifying the same elements by the same reference numerals.

The spring member 47*a* is disengageably and unrotatably mounted by fitting the engaging hole 54 with the mount projection 49*a* while arranging the base plate 52 and the mount body 35 such that they extend in orthogonal directions until the base plate 52 is pressed against the projected portion 48 as shown by phantom line in FIG. 9, and by engaging the leading ends of the engaging portions 55*a* with the hooks 50*a* formed at the longer side surfaces of the mount projection 49*a*.

Since the engaging portions 55*a* are engaged with the hooks 50*a* while extending in the direction normal to the deformation direction of the bent portions 53, a small stress acts on the engaging portions 55*a* even when the bent portions 53 are deformed and, hence, the engaging portions 55*a* have an excellent strength.

The embodiments illustrated in FIGS. 1–9 show the handle 40 being pivoted into an inclined position substantially adjacent the portion of the upper casing 3 overlying the fuse 12. However, the handle 40 can be inclined in a direction opposite from that of the foregoing embodiments if it is more convenient in view of an installation space. Even in such a case, the handle 40 can be immovably and stably held as in the foregoing embodiments. Since the magnets 63 are symmetrically disposed at the opposite side portions of the handle 40, the detection signal by the lead switch 65 can be obtained even if the insertion is performed while the handle 40 or the movable electrode 31 are held in a reversed position with respect to the longitudinal direction.

FIGS. 10 to 18 show a third embodiment of the invention. The elements of the third embodiment being the same or similar as those elements of the preceding embodiments are denoted with the same reference numerals and a detailed description thereof is omitted in the following.

Specifically, the handle 40 is pivotable about the support shafts 45 by bringing the bent portion 53 of the spring member 47 into contact with the contact surface 58 and causing it to elastically contract. During this time, upon being subject to a kind of toggle action, the handle 40 can stably be held in the standing position where it extends in a direction opposite from the projecting direction of the louver or fittable terminals 32*a*, 32*b* while the contact surface 58 is held in contact with the bent portions 53 to their leading ends and in the resting position where it extends in a direction normal to the projecting direction of the fittable terminals 32*a*, 32*b* while the contact surface 58 is substantially completely held in contact with the side surface of either one of the bent portions 53.

Further in this embodiment, there is provided a means for preventing the handle 40 from wobbling while the movable electrode 31 is inserted and for preventing the insufficient connection of the movable electrode 31 and the fixed electrodes 11*a*, 11*b*. Hereafter, this means is described.

At each of the opposite end surfaces of the handle 40 where the support shaft 45 is inserted, a slidable projection 70 having a substantially rectangular shape when viewed from front is so formed as to project by a specified distance. An insertion hole 71 for the support shaft 45 is concentrically formed in the slidable projection 70 with the above bearing hole 44.

Figure 15:
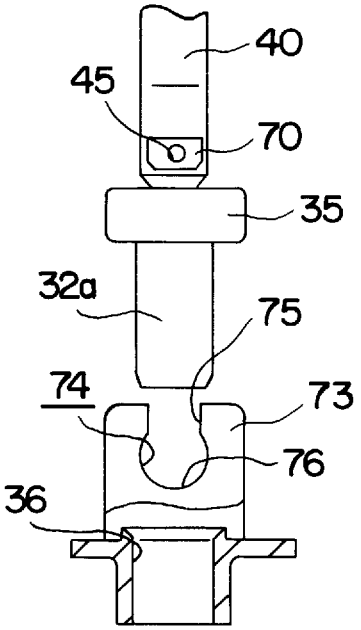
FIG. 15 is a partial side view showing a state before the handle is inserted.

On the other hand, a guide column 73 stands at each of left and right sides of the upper surface of the upper casing 3 where the handle 40 is inserted. Each guide column 73 is formed with a guide slot 74 for guiding the slidable projection 70 while the handle 40 is inserted. The guide slot 74 is open, in particular upward, and extends along the substantially vertical direction as shown in FIG. 15. A substantially linear portion 75, acting as a rotation preventing means in which the slidable projection 70 is unrotatably and freely slidably fittable is formed at an upper part of each guide slot 74, and a rotation permitting portion 76, having in particular a substantially circular shape, whose diameter is larger than the width of the linear portion 75 so as to permit the rotation of the slidable projection 70 about the support shaft 45, is formed at a lower part thereof.

When the movable electrode 31 starts fitting to the fixed electrodes 11*a*, 11*b* while the handle 40 is being inserted, the slidable projections 70 start entering the linear portions 75. When the insertion of the handle 40 is completed by properly fitting the movable electrode 31 to the fixed electrodes 11*a*, 11*b*, the slidable projections 70 reach the rotation permitting portions 76.

The third embodiment is constructed as described above, and the operation thereof is described hereafter.

The pair of fixed electrodes 11*a*, 11*b* are placed upright and the fuse 12 is accommodated in the casing 1, and connected in a manner as described above between the cut ends of the wire "a". In order to bring the wire "a" into its conductive state, the handle 40 is raised to its standing position outside the casing 1. The handle 40 is stably held in its standing position by the toggle action as described above.

Subsequently, the handle 40 is gripped to insert the fittable terminals 32*a*, 32*b* of the movable electrode 31 projecting from the mount body 35 into the insertion holes 36 of the upper casing. Since the handle 40 is held onto the mount body 35, the mount body 35 or the movable electrode 31 does not wobble. Accordingly, the fittable terminals 32*a*, 32*b* can be smoothly inserted into the insertion holes 36.

Figure 16:
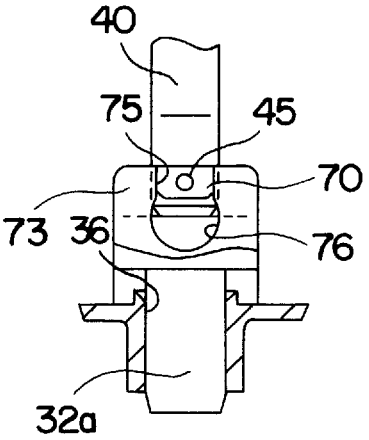
FIG. 16 is a partial side view showing a state while the handle is being inserted.

When the fittable terminals 32*a*, 32*b* start fitting to the corresponding fixed electrodes 11*a*, 11*b* as the handle 40 is further inserted, the handle 40 is subjected to a fitting resistance caused by the fitting of the fittable terminals 32*a*, 32*b* to the fixed electrodes 11*a*, 11*b* and the force of the spring member 47 becomes insufficient to hold the handle 40, with the result that the handle 40 may wobble. However, when the fittable terminals 32*a*, 32*b* start fitting, the slidable projections 70 provided at the handle 40 enter the linear portions 75 of the guide slots 74 as shown in FIG. 16. Since the rotation of the slidable projections 70 are prevented in the linear portions 75, the handle 40 is pushed in straight without wobbling, smoothly fitting the fittable terminals 32*a*, 32*b* to the fixed electrodes 11*a*, 11*b*. Accordingly, the breaker switch 38 is turned on to bring the wire "a" into an electrically conductive state, in particular via the fuse 12.

Figure 17:
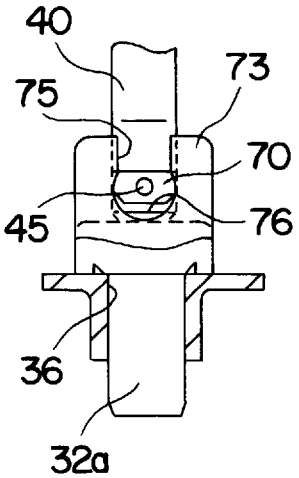
FIG. 17 is a partial side view showing a state after the insertion of the handle is completed.
Figure 18:
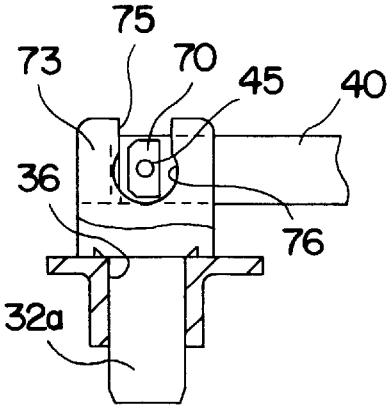
FIG. 18 is a partial side view showing a state where the handle is in its resting position.

Here, if the fittable terminals 32*a*, 32*b* of the movable electrode 31 are properly fitted to the corresponding fixed electrodes 11*a*, 11*b*, the slidable projections 70 move beyond the linear portions 75 of the guide slots 74, reaching the rotation permitting portions 76 as shown in FIG. 17. Since the slidable projections 70 are permitted to rotate about the support shafts 45, the handle 40 standing upright can be inclined to the resting position as shown in FIG. 18. The handle 40 is held also in the resting position by the toggle action of the spring member 47. Thus, the handle 40 does not wobble even upon being subjected to a vibration or the like while the vehicle is running, thereby preventing generation of unusual noises.

On the other hand, in an insufficiently engaged state where the fittable terminals 32*a*, 32*b* of the movable electrode 31 are not properly engaged with the fixed electrodes 11*a*, 11*b*, the slidable projections 70 are still in the linear portions 75 as shown in FIG. 16 and, accordingly, cannot rotate. Thus, the handle 40 cannot be inclined. The insufficiently engaged state can be detected in this manner. In such a case, the handle 40 is pushed again to its proper position.

Since the slidable projection 70 and the guide slot 74 are provided at both left and right sides, the same action as above can be expected even if the handle 40 is inserted after being rotated 180° on a horizontal plane.

Further, if the handle 40 is inclined to the resting position after the movable electrode 31 is properly fitted to the fixed electrodes 11*a*, 11*b* as described above, one of the magnets 63 provided at the handle 40 is located right before the lead switch 65. Accordingly, the lead switch 65 outputs the detection signal, thereby electrically detecting that the breaker switch 38 has been turned on.

Figure 12:
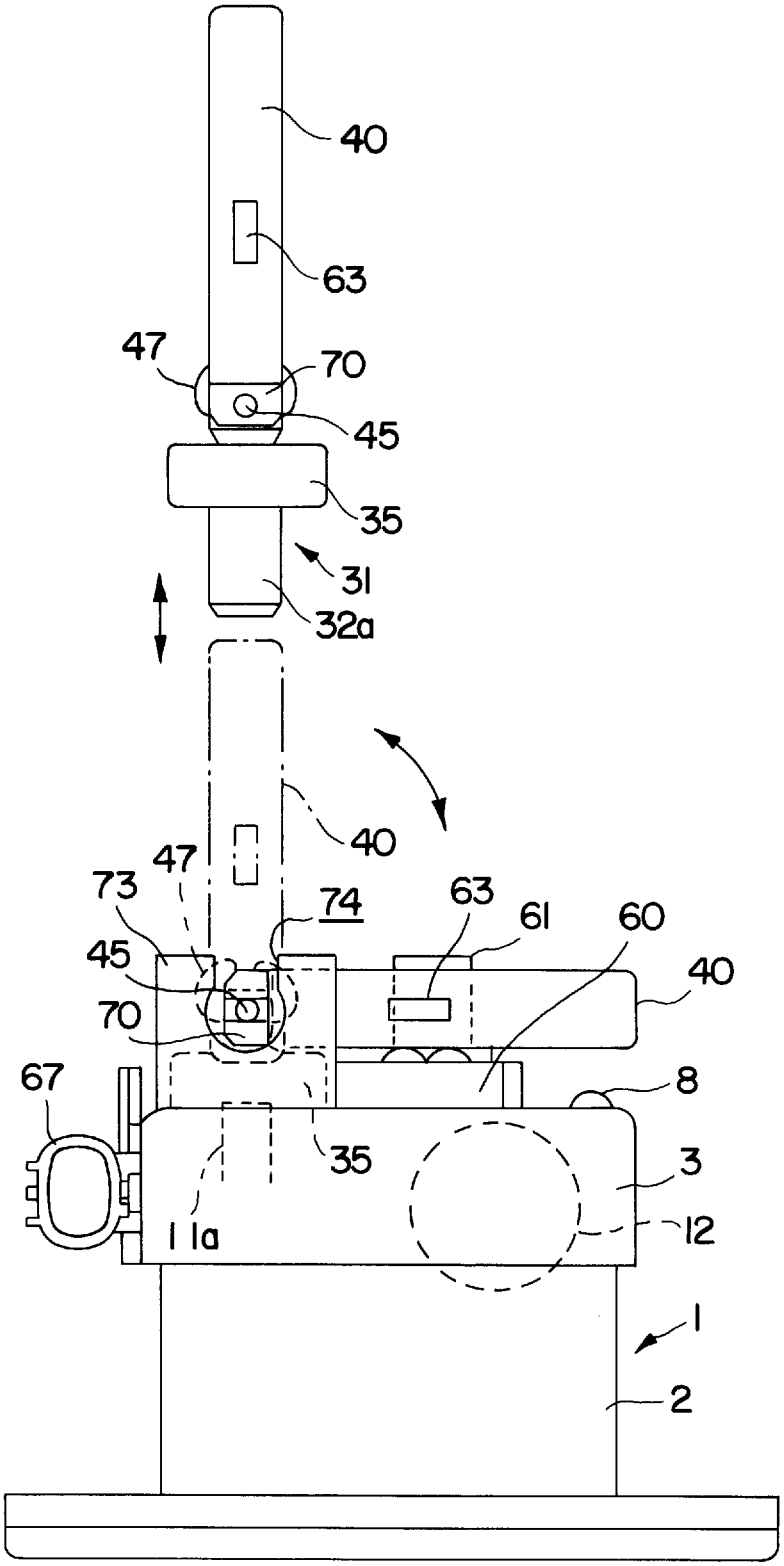
FIG. 12 is a side view showing how the handle is used for the engagement and disengagement of electrodes.
Figure 13:
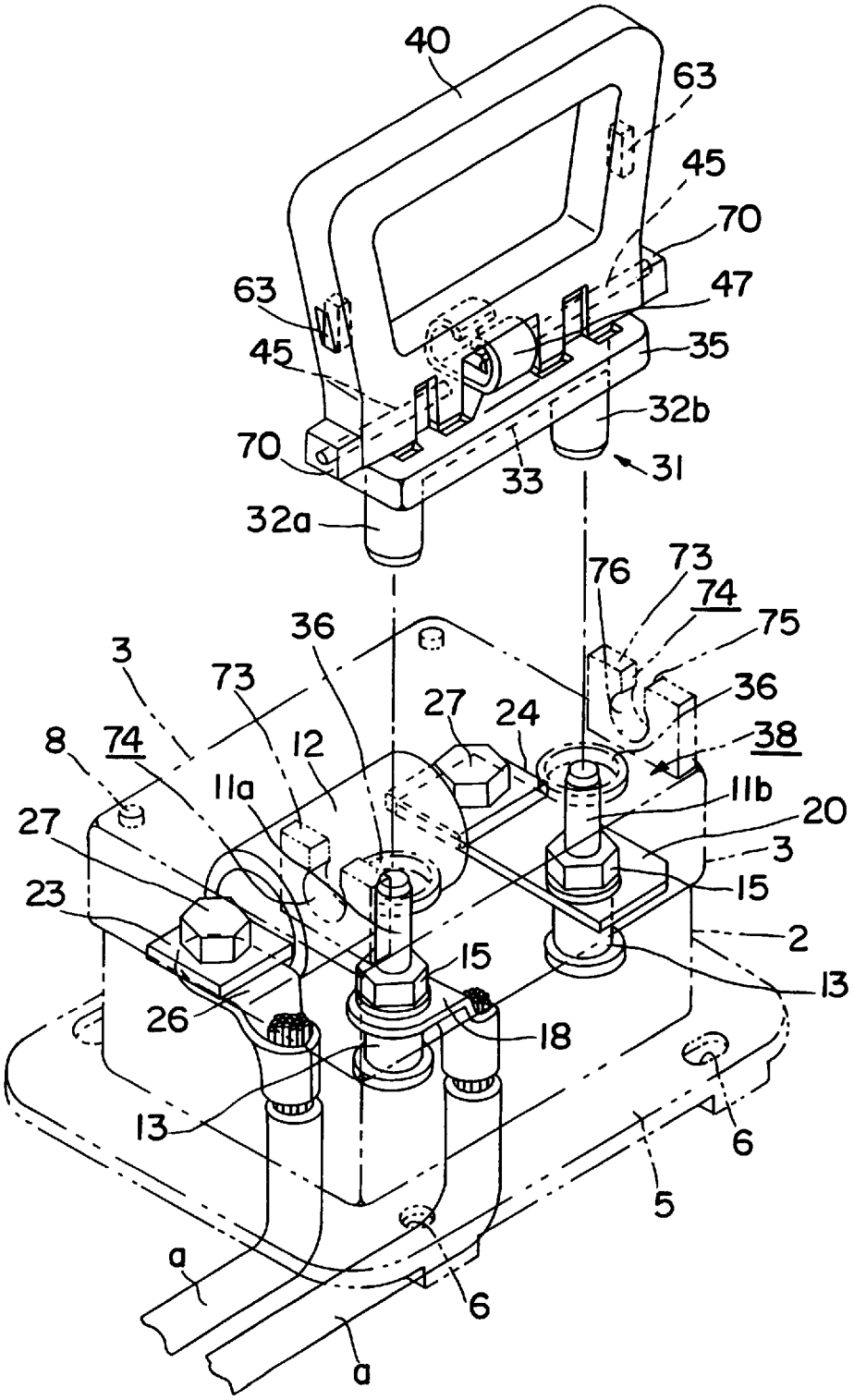
FIG. 13 is a perspective view showing the interior construction of a casing and the construction of a mount body.
Figure 14:
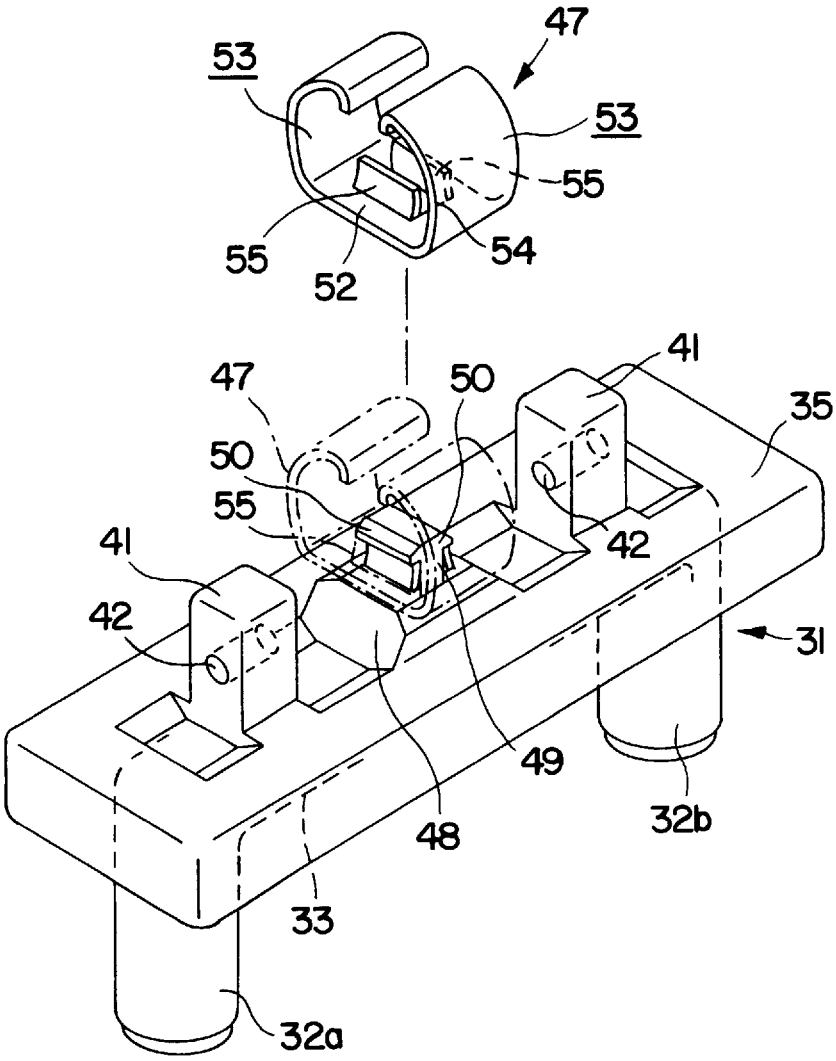
FIG. 14 is a perspective view showing the construction of a portion where a spring member is mounted.

When the breaker switch 38 is turned off for the maintenance, the handle 40 is raised to the standing position from the resting position indicated by solid line in FIG. 12. The handle 40 is then pulled up to withdraw the movable electrode 31 from the fixed electrodes 11*a*, 11*b*, with the result that the breaker switch 38 is turned off, bringing the wire "a" into a nonconductive state.

Further, when the fuse 12 blows out, the breaker switch 38 is turned off by withdrawing the movable electrode 31 in the similar manner as above, and the screws 8 are loosened to remove the upper casing 3. Since the fuse 12 is exposed in this state, the fuse 12 is removed by loosening the bolts 27 and replaced with a new one. Because the breaker switch 38 is already turned off, the fuse 12 can be safely exchanged.

The slidable projections 70 may be provided at the casing 1, whereas the guide slots 74 may be provided at the movable handle 40.

As described above, the breaker device of this embodiment is excellent in safety because of its construction in which the conductive path is located inside the casing 1 and is allowed to have a compact configuration of particularly low height while being in use because the handle 40 can be inclined to the resting position.

Further, while the movable electrode 31 is being fitted, the handle 40 is held in its standing position despite the fitting resistance, i.e. the handle 40 can smoothly be inserted without wobbling. Further, the handle 40 cannot be inclined unless the movable electrode 31 is properly fitted to the fixed electrodes 11*a*, 11*b*, preventing the movable electrode 31 and the fixed electrodes 11*a*, 11*b* from being left insufficiently engaged.

Figure 19:
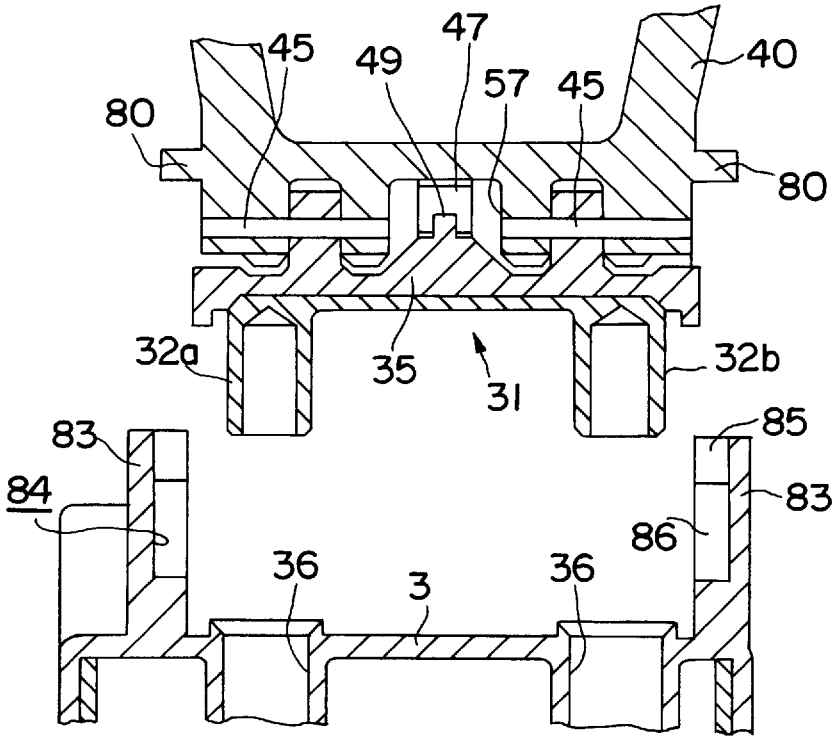
FIG. 19 is a partial section of a handle according to a fourth embodiment of the invention before the insertion when viewed from front.
Figure 20:
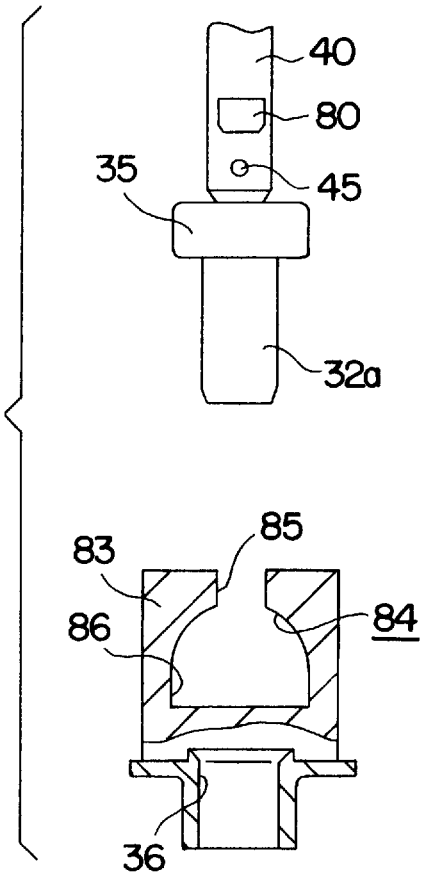
FIG. 20 is a side view partly in section of the fourth embodiment.

FIGS. 19 to 22 show a fourth embodiment of the invention. In this embodiment, slidable projections 80 provided at the handle 40 are distanced upward from the support shafts 45 as shown in FIGS. 19 and 20.

On the other hand, a pair of guide columns 83 stand at the opposite sides of the upper surface of the upper casing 3 wherein the handle 40 is inserted. In the inner surface of each guide column 83, there is formed a guide slot 84 for guiding the insertion of the slidable projection 80 while the handle 40 is inserted. The guide slot 84 is open toward a direction of withdrawal of the louver terminals 32*a*, 32*b*, in particular upward, and extends along the insertion direction, in particular the vertical direction as shown in FIG. 20. A linear portion 85 in which the slidable projection 80 is freely slidably fittable is formed at an upper part of each guide slot 84, and a pivotal movement permitting portion 86 which is more widened than the linear portion 85 so as to permit the pivotal movement of the slidable projection 80 about the support shaft 45 is formed at a lower part thereof.

When the movable electrode 31 starts fitting to the fixed electrodes 11*a*, 11*b* while the handle 40 is being inserted, the slidable projections 80 start entering the substantially linear portions 85 of the guide slots 84. Upon the completion of the insertion where the movable electrode 31 is properly fitted to the fixed electrodes 11*a*, 11*b*, the slidable projections 80 reach the pivotal movement permitting portion 86.

Since the other construction is similar to the third embodiment, no repetitive description is given thereon by identifying the same elements by the same reference numerals.

Figure 21:
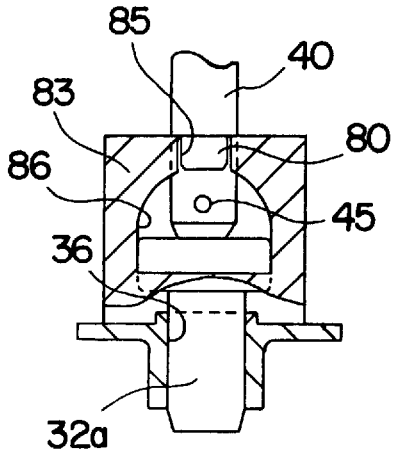
FIG. 21 is a side view partly in section showing a state while the handle is being inserted.

The fourth embodiment operates as follows. When the fittable terminals 32*a*, 32*b* start fitting to the corresponding fixed electrodes 11*a*, 11*b* as the movable electrode 31 is further inserted, the slidable projections 80 move along the linear portions 85 of the guide slots 84 as shown in FIG. 21. While being in the linear portions 85, the slidable projections 80 cannot make a pivotal movement. Accordingly, the handle 40 is pushed straight in without wobbling, thereby smoothly fitting the fittable terminals 32*a*, 32*b* to the fixed electrodes 11*a*, 11*b*.

Figure 22:
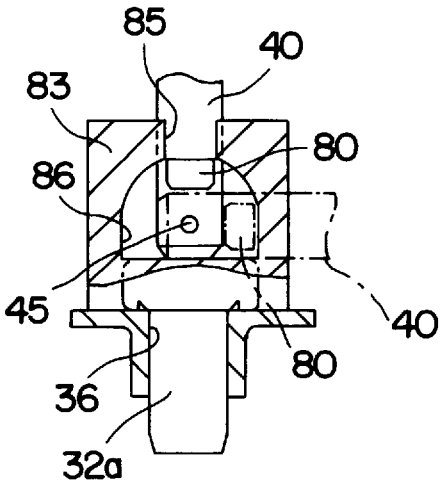
FIG. 22 is a side view partly in section showing a state the insertion of the handle is completed.

When the movable electrode 31 is properly fitted to the fixed electrodes 11*a*, 11*b*, the slidable projections 80 pass the linear portions 85, reaching the pivotal movement permitting portions 86 as shown in FIG. 22. Accordingly, the handle 40 in the standing position can be inclined to the resting position indicated by phantom line in FIG. 22 while the slidable projections 80 are pivoted about the support shafts 45 in the pivotal movement permitting portions 86.

On the other hand, in an insufficiently engaged state where the movable electrode 31 is not properly engaged with the fixed electrodes 11*a*, 11*b*, the handle 40 cannot be inclined or pivoted because the slidable projections 80 are still located in the linear portions 85 as shown in FIG. 21 and, therefore, cannot make a pivotal movement. The insufficiently engaged state can be detected in this manner. If the handle 40 is inclined in the insufficient engaged state, i.e. while the slidable projections 80 are located in the linear portions 85 of the guide slots 84, the slidable projections 80 are wrenched in the linear portions 85. However, since the slidable projections 80 are distanced from the support shafts 45 as a center of inclination of the handle 40, a force which will act on the slidable projections 80 and the guide slots 84 can be suppressed, preventing the slidable projections 80 and the guide slots 84 from being damaged.

The invention is not limited to the breaker device where the fuse is provided at the side of the breaker switch, but also applicable to a breaker device singly including a breaker switch.

Figure 23:
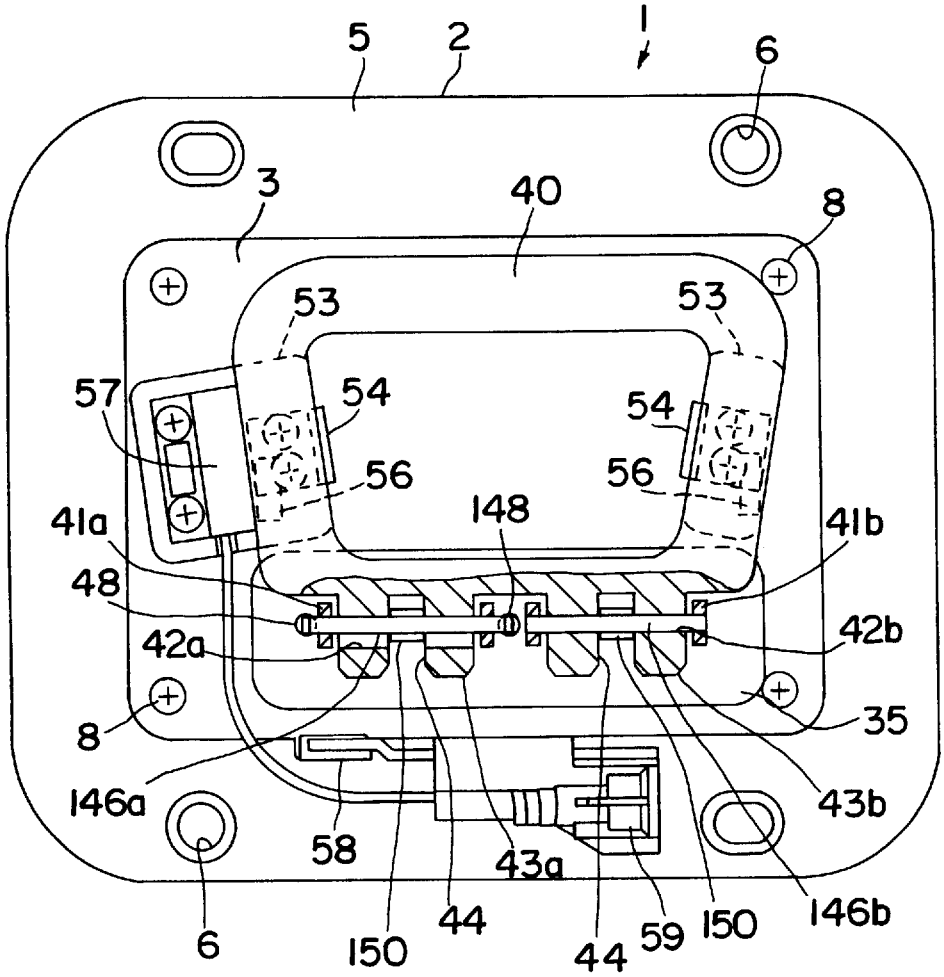
FIG. 23 is a plan view of a fifth embodiment of the invention when a handle is in its resting position.
Figure 24:
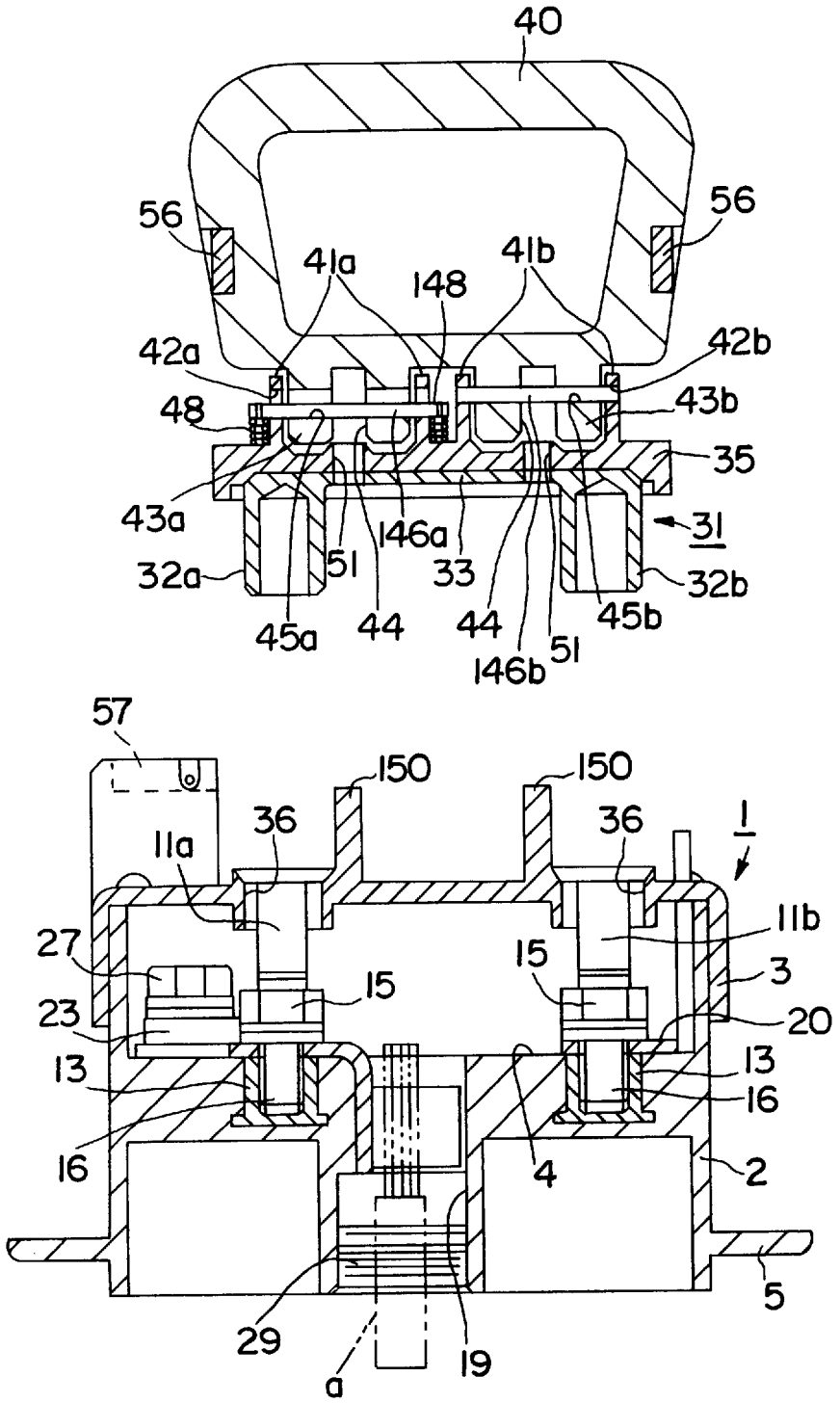
FIG. 24 is a vertical section showing a state before the handle is inserted.

FIGS. 23 to 24 show a fifth embodiment of the invention. The elements of the fifth embodiment being the same or similar as those elements of the preceding embodiments are denoted with the same reference numerals and a detailed description thereof is omitted in the following.

A handle 40 used to engage and disengage the movable electrode 31 is provided at the upper surface of the mount body 35. The handle 40 is in the form of a frame having an outer shape e.g. of a reverse trapezoid. Pairs of spaced apart bearing plates 41*a*, 41*b* stand at the opposite sides of the longitudinal center of the upper surface of the mount body 35. The bearing plates 41*a*, 41*b* are formed with bearing holes 42*a*, 42*b*. The pair of bearing holes 42*a* on the left side of FIG. 24 are oblong holes, whereas the pair of bearing holes 42*b* on the right side of FIG. 24 are round holes. The upper ends of the oblong bearing holes 42*a* are on a level with the bearing holes 42*b*.

On the other hand, at a mount end of the handle 40, bearing portions 43*a*, 43*b* project so as to be insertable between the corresponding pairs of the bearing plates 41*a*, 41*b*. The bearing portions 43*a*, 43*b* are so forked as to provide insertion holes 44 into which push-up pin 150 are insertable, and are formed with bearing holes 45*a*, 45*b*. The bearing hole 45*a* on the left side is an oblong hole so as to correspond to the bearing holes 42*a* of the bearing plates 41*a*, whereas the bearing hole 45*b* on the right side is a round hole so as to correspond to the bearing holes 42*b*.

The left and right bearing portions 43*a*, 43*b* of the handle 40 are inserted between the corresponding bearing plates 41*a*, 41*b*, and support shafts 146*a*, 146*b* are relatively rotatably or pivotably inserted through the bearing holes 42*a* and the bearing hole 45*a* on the left side and through the bearing holes 42*b* and the bearing hole 45*b* on the right side, respectively. The left support shaft 146*a* is longer than the right support shaft 146*b*, and is mounted such that its opposite ends project outward from the bearing plates 41*a*. Tension coil springs 148 are mounted between the opposite projecting ends of the left support shaft 146*a* and the upper surface of the mount body 35. The support shaft 146*a* is biased by the contractive forces of the springs 148 so as to move downward in FIG. 24, with the result that the support shaft 146*a* is located at the bottom of the bearing holes 42*a*, 45*a*. In other words, the axes of the left and right support shafts 146*a*, 146*b* are constantly displaced, thereby uninclinably holding the handle 40 in its standing position with respect to the mount body 35.

On the other hand, a pair of push-up pins 150 insertable into the left and right insertion holes 44 of the handle 40 stand on the upper surface of the upper casing 3. In the mount body 35 and the bridging member 33 of the movable electrode 31, through holes 51 into which the push-up pins 150 are insertable are so formed as to conform to the insertion holes 44. When the louver or fittable terminals 32*a*, 32*b* of the movable electrode 31 are inserted into the insertion holes 36 of the upper casing 3 as the handle 40 is moved downward, the push-up pins 150 enter the insertion holes 44 through the through holes 51, thereby pushing up the support shaft 146*a* against the elastic force of the tension coil spring 148. When the fittable terminals 32*a*, 32*b* are pressed to a position where they are properly fitted to the corresponding fixed electrodes 11*a*, 11*b*, the support shaft 146*a* is pushed to a position on a level with the other support shaft 146*b*.

Figure 26:
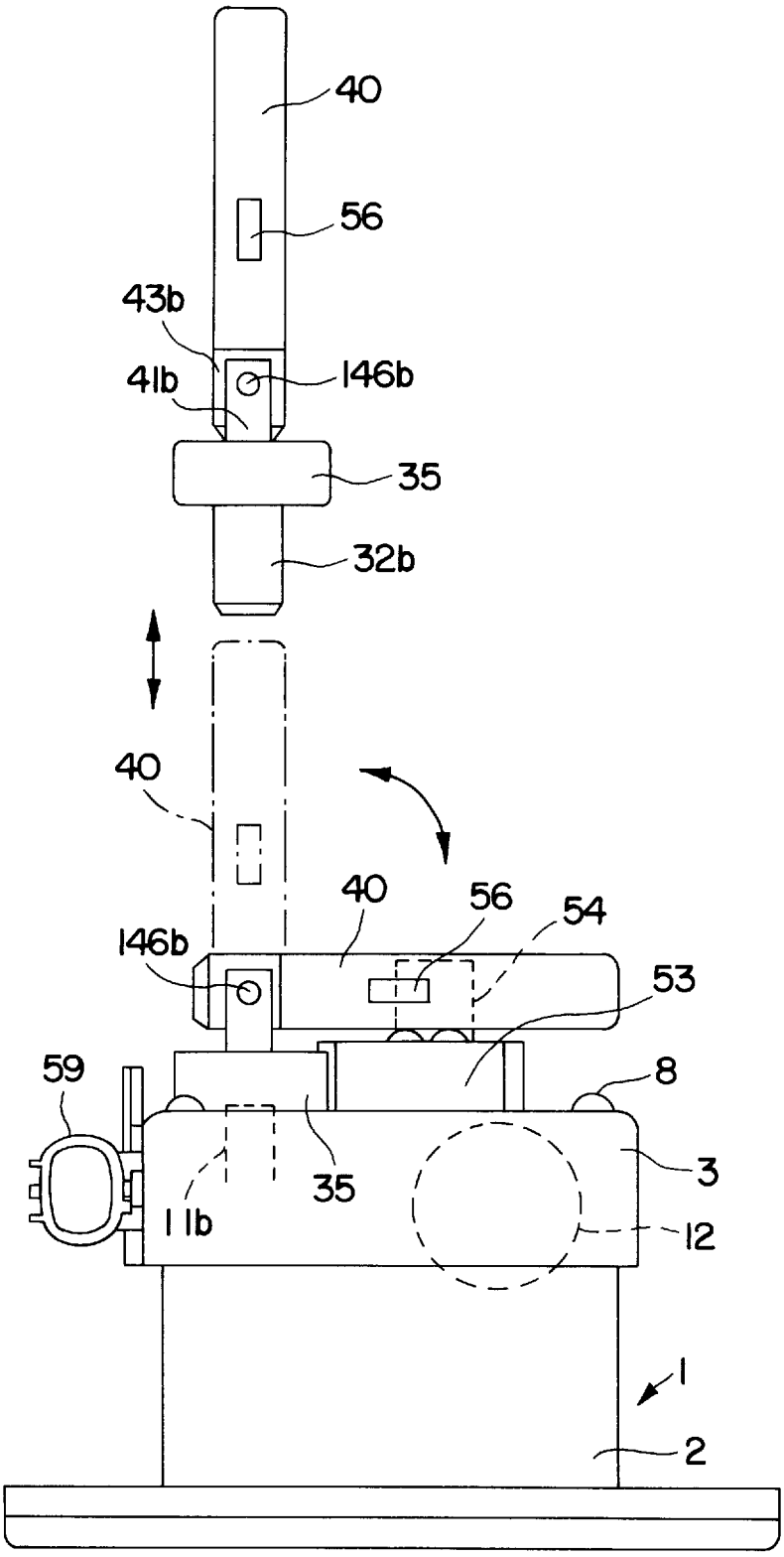
FIG. 26 is a side view showing how the handle is used for the engagement and disengagement of electrodes.
Figure 27:
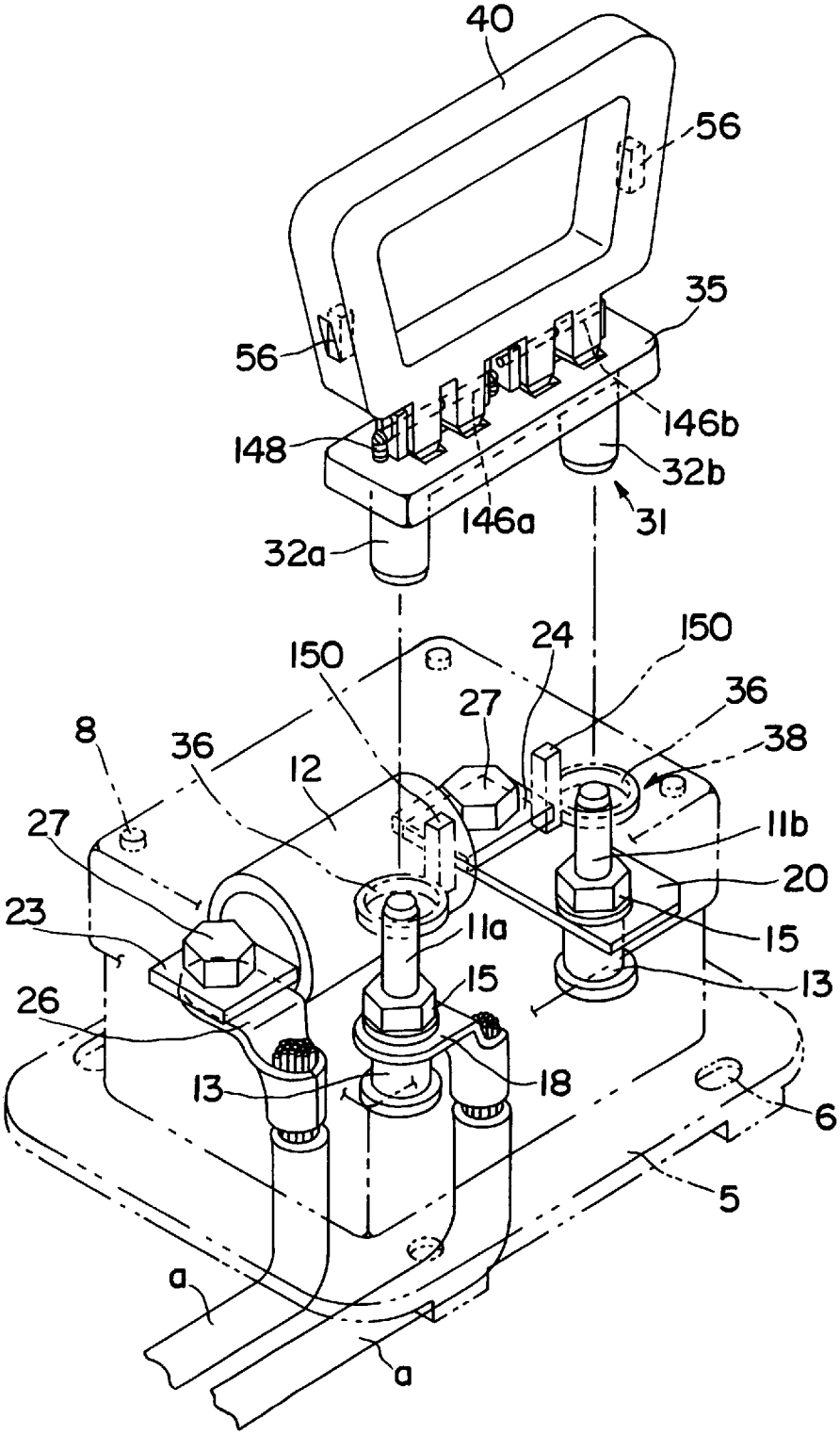
FIG. 27 is a perspective view showing the internal construction of a casing and the construction of a mount body.
Figure 28:
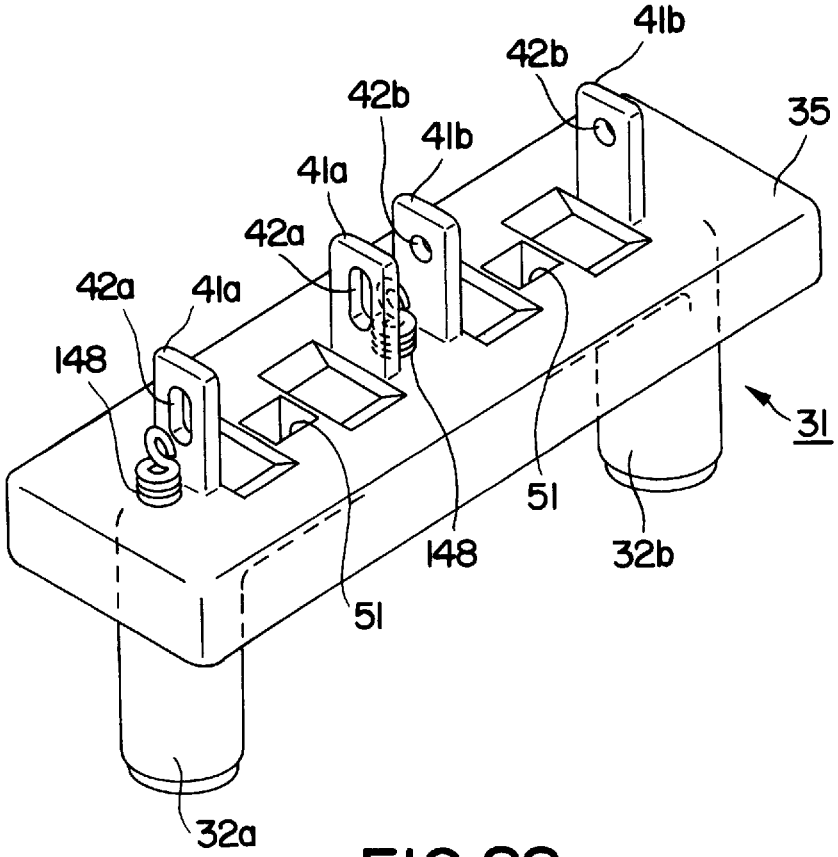
FIG. 28 is a perspective view of the mount body.

In positions of the ceiling surface of the upper casing 3 corresponding to the accommodated fuse 12, support tables 53 are provided as shown in FIGS. 23 and 26. An L-shaped receiving member 54 is mounted on each support table 53. The receiving members 54 receive the substantially center portions of the opposite side portions of the handle 40 when the movable electrode 31 is properly engaged with the fixed electrodes 11*a*, 11*b* and the handle 40 is inclined to its resting position shown in FIG. 26.

Magnets 56 are mounted in symmetrical positions of the outer surfaces of the opposite side portions of the hand 40. On the other hand, a lead switch 57 is mounted on the ceiling surface of the upper casing 3. The lead switch 57 is so disposed as to be located substantially right before one of the magnets 56 when the movable electrode 31 is properly engaged with the fixed electrodes 11*a*, 11*b* and the handle 40 is inclined to its resisting position as described above, and outputs a detection signal when the magnet 56 comes right before it. The lead switch 57 is connected with an unillustrated computer for performing necessary controls via a connector 59 mounted by a bracket 58 at one side surface of the upper casing 3.

Figure 29:
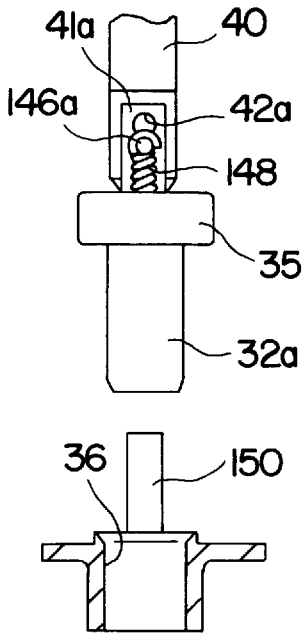
FIG. 29 is a partial side view showing a state before the handle is inserted.

The fifth embodiment is constructed as described above, and the operation thereof is described hereafter. The pair of fixed electrodes 11*a*, 11*b* are placed upright and the fuse 12 is accommodated in the casing 1, and connected in a manner as described above between the cut ends of the wire "a". In order to bring the wire "a" into its conductive state, the handle 40 is raised to its standing position to insert the movable electrode 31. While the handle 40 is in its standing position, the axes of the left and right support shafts 146*a*, 146*b* are displaced as shown in FIGS. 24 and 29 because the left support shaft 146*a* is pulled by the elastic forces of the tension coil springs 148.

The fittable terminals 32*a*, 32*b* of the movable electrode 31 are inserted into the insertion holes 36 of the upper casing 3 by gripping the handle 40. At this time, the handle 40 cannot be inclined with respect to the mount body 35 because the axes of the support shafts 146*a*, 146*b* are displaced as described above. Accordingly, the insertion can smoothly be performed since the mount body 35 or the movable electrode 31 does not wobble.

When the fittable terminals 32*a*, 32*b* start fitting to the corresponding fixed electrodes 11*a*, 11*b* by the above insertion, the handle 40 may be inclined upon being subject to a fitting resistance. On the other hand, during the insertion, the push-up pins 150 standing on the upper casing 3 are inserted into the insertion holes 44 of the handle 40 through the through holes 51, thereby gradually pushing up the left support shaft 146*a* in the bearing holes 42*a*, 45*a*. Since the axes of the support shafts 146*a*, 146*b* are still displaced, the handle 40 cannot be inclined. Accordingly, since the handle 40 is pushed in straight while being held in its standing position, the fittable terminals 32*a*, 32*b* are smoothly fitted to the fixed electrodes 11*a*, 11*b*. Thus, the breaker switch 38 is turned on to bring the wire "a" into an electrically conductive state, in particular via the fuse 12.

Figure 25:
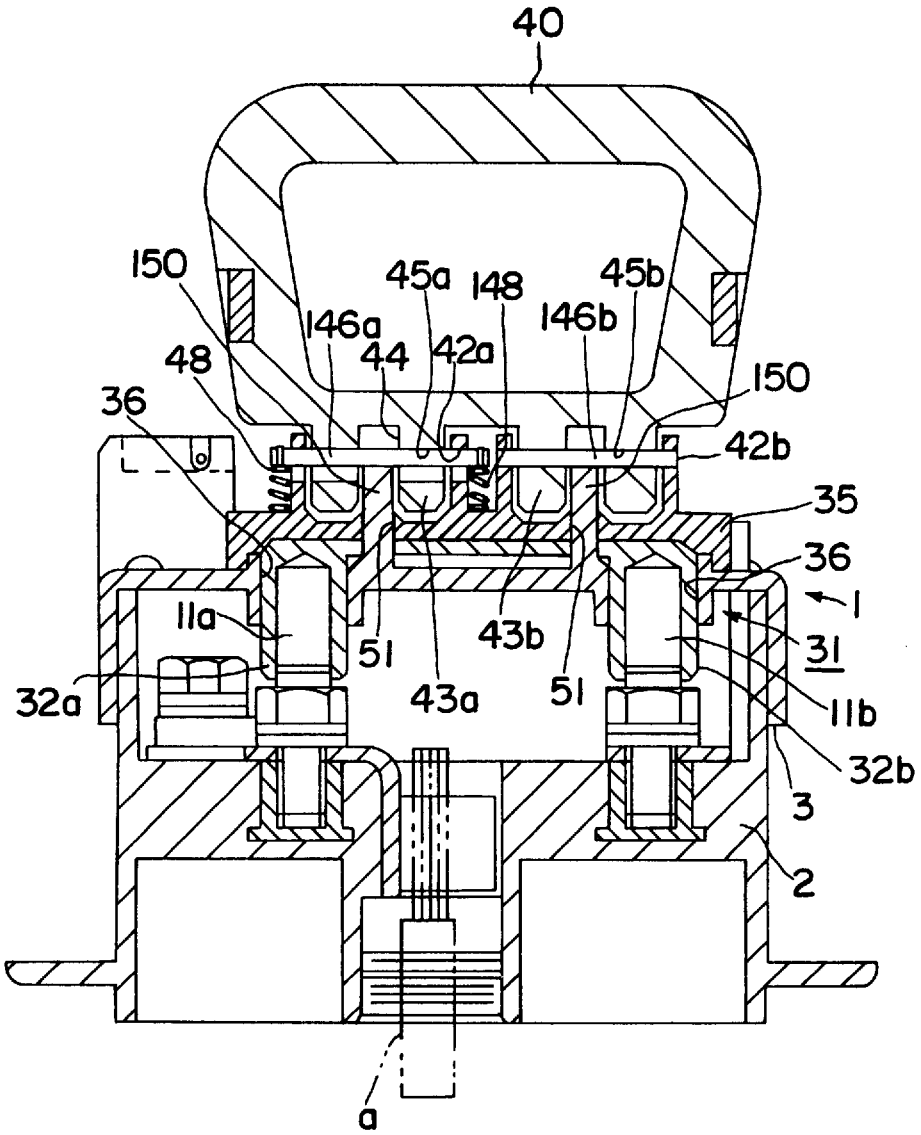
FIG. 25 is a side view showing a state after the insertion of the handle is completed.
Figure 30:
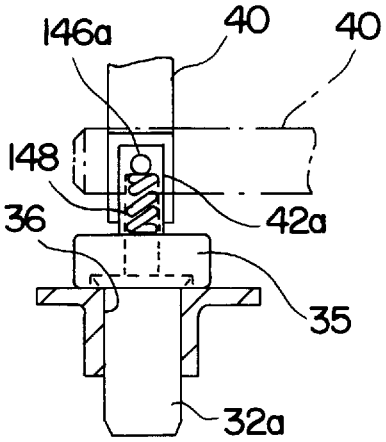
FIG. 30 is a partial side view showing a state after the insertion of the handle is completed.

Here, if both fittable terminals 32*a*, 32*b* of the movable electrode 31 are properly fitted to the corresponding fixed electrodes 11*a*, 11*b*, the left support shaft 146*a* is located at the upper ends of the bearing holes 42*a*, 45*a* where it is coaxial with the right support shaft 146*b* as shown in FIGS. 25 and 30, and the handle 40 in its standing position can be pivoted about the support shafts 146*a*, 146*b* to its resting position as shown in FIG. 26.

On the other hand, in an insufficiently engaged state where the fittable terminals 32*a*, 32*b* of the movable electrode 31 are not properly fitted to the fixed electrodes 11*a*, 11*b*, the left support shaft 146*a* is located in intermediate positions of the bearing holes 42*a*, 45*a*, i.e. the axes thereof are displaced from that of the right support shaft 146*b*. Accordingly, the handle 40 cannot be inclined even if an attempt is made. In this way, the insufficient engaged state can be detected. In such a case, the handle 40 is pressed again to its proper position.

Since the pair of push-up pins 150 are preferably symmetrically arranged with respect to the widthwise direction, the breaker device operates as above even if the handle 40 is inserted after being rotated 180° on a horizontal plane.

Further, if the handle 40 is inclined to the resting position after the movable electrode 31 is properly fitted to the fixed electrodes 11*a*, 11*b* as described above, one of the magnets 56 provided at the handle 40 is located right before the lead switch 57. Accordingly, the lead switch 57 outputs the detection signal, thereby electrically detecting that the breaker switch 38 has been turned on.

When the breaker switch 38 is turned off for the maintenance, the handle 40 is raised to the standing position from the resting position indicated by solid line in FIG. 26. The handle 40 is then pulled up to withdraw the movable electrode 31 from the fixed electrodes 11*a*, 11*b*, with the result that the breaker switch 38 is turned off, bringing the wire "a" into a nonconductive state.

Further, when the fuse 12 blows out, the breaker switch 38 is turned off by withdrawing the movable electrode 31 in the similar manner as above, and the screws 8 are loosened to remove the upper casing 3. Since the fuse 12 is exposed in this state, the fuse 12 is removed by loosening the bolts 27 and replaced with a new one. Because the breaker switch 38 is already turned off, the fuse 12 can be safely exchanged.

The push-up pins 150 and through holes 51 may have a substantially circular cross section.

As described above, the breaker device according to this embodiment is excellent in safety because of its construction in which the conductive path is located inside the casing 1 and is allowed to have a compact configuration of particularly low height while being in use because the handle 40 can be inclined to the resting position.

Since the handle 40 is held in its standing position without wobbling during the insertion of the movable electrode 31 into the insertion holes 36, the insertion can easily and smoothly be performed without holding the movable electrode 31 by hand. Further, since the handle 40 is held in its standing position during the insertion despite the fitting resistance, the insertion can smoothly be performed to the end. Furthermore, since the handle 40 cannot be inclined unless the movable electrode 31 and the fixed electrodes 11*a*, 11*b* are properly fitted, it prevents the electrodes 31, 11*a*, 11*b* from being held insufficiently engaged.

FIGS. 31 to 34 show a sixth embodiment of the invention. In the sixth embodiment, a change is made in the construction for switchably supporting the handle 40 in a state where it is inclinable with respect to the mount body 35 of the movable electrode 31 and in a state where it is not inclinable with respect thereto.

Figure 31:
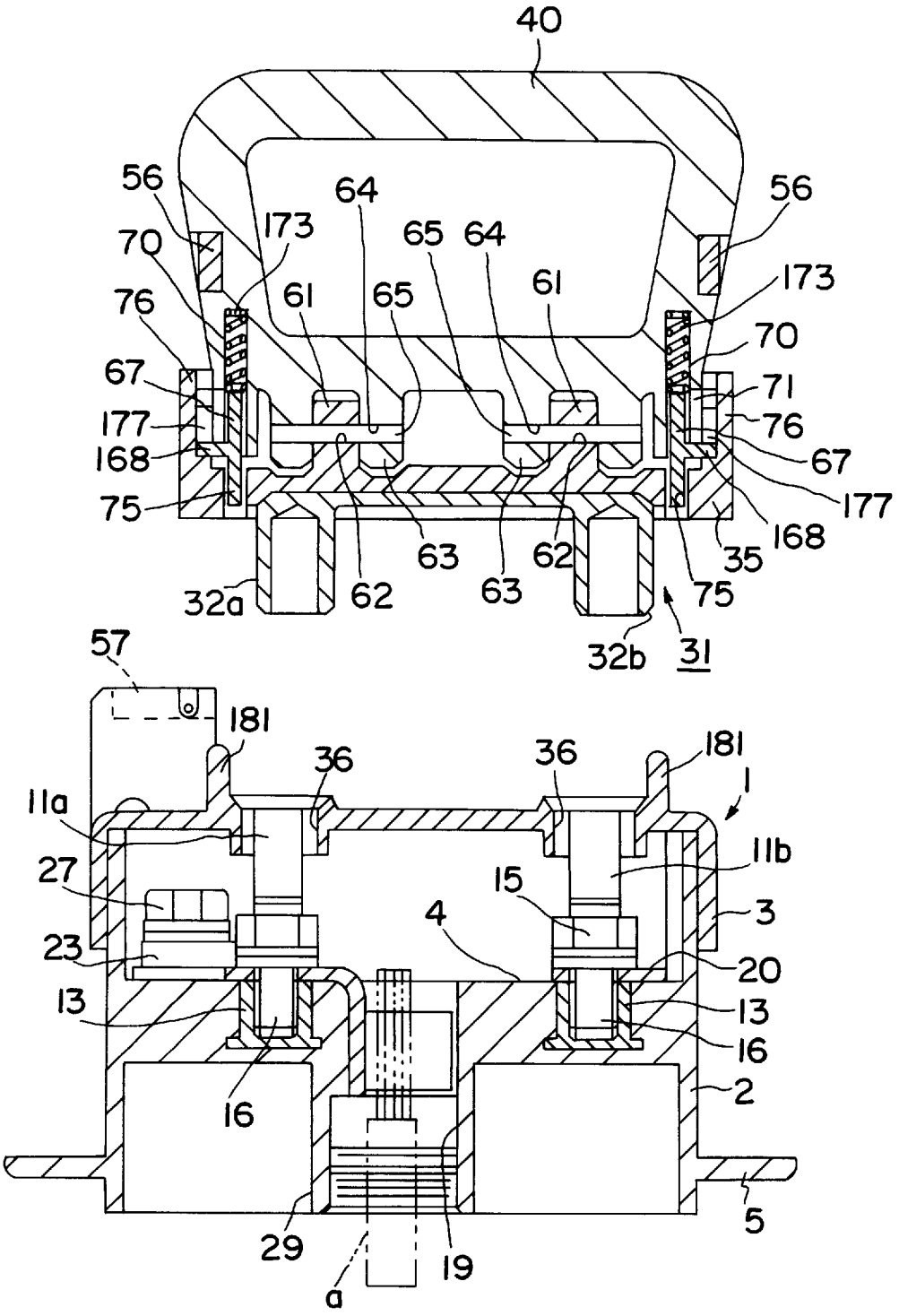
FIG. 31 is a section of a sixth embodiment of the invention showing a state before a handle is inserted.
Figure 32:
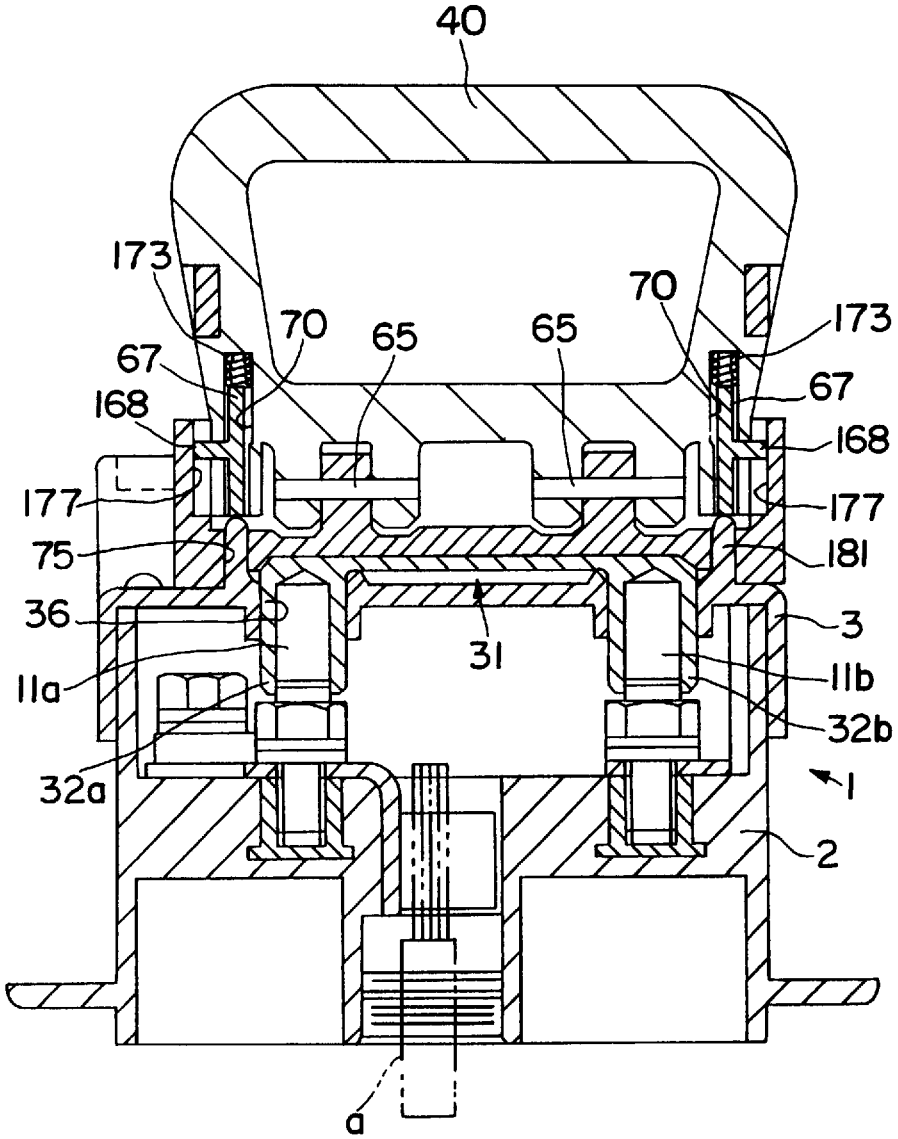
FIG. 32 is a section showing a state after the insertion of the handle is completed.

As shown in FIG. 31, bearing portions 61 formed with bearing holes 62 project at the opposite end portions of the upper surface of the mount body 35 with respect to the length of the mount body 35, whereas a pair of bearing portions 63 forked so as to hold or position the corresponding bearing portions 61 and formed with bearing holes 64 project at the mount end of the handle 40. By inserting the bearing portions 61 of the mount body 35 into the forked bearing portions 63 of the handle 40 and inserting support shafts 65 through the bearing holes 62, 64 of the bearing portions 61, 63, the handle 40 is pivotally supported about the support shafts 65 at the upper surface of the mount body 35.

Figure 33:
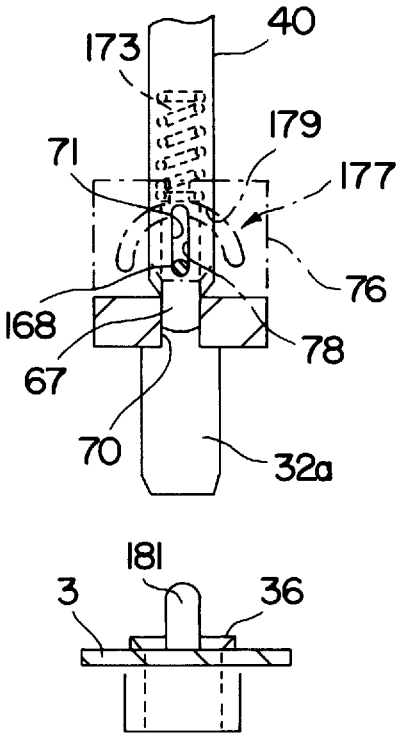
FIG. 33 is a partial side view showing a state before the handle is inserted.
Figure 34:
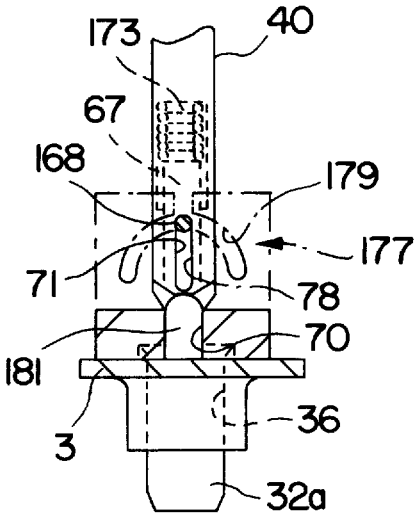
FIG. 34 is a partial side view showing a state after the insertion of the handle is completed.

A pair of slide bars 67 are mounted at the substantially opposite ends of the mount end of the handle 40. A pin 168 project outward from each slide bar 67 in an intermediate position with respect to the length of the slide bar 67. A pair of slide holes 70 are formed at the handle 40, and oblong holes 71 opening in the outer surfaces communicate with the slide holes 70 as also shown in FIG. 33. Specifically, the slide bars 67 are slidably fitted into the corresponding slide holes 70 while the pins 168 are moved along the oblong holes 71. A compression coil spring 173 is mounted at the back end of each slide hole 70.

In the upper surface of the mount body 35, there are formed insertion holes 75 into which the leading ends of the slide bars 67 are insertable. Further, guide plates 76 stand at the opposite ends of the upper surface of the mount body 35. In the inner surface of each guide plate 76, there is formed a guide slot 177 in which the leading end of the pin 168 of the slide bar 67 projecting from the oblong hole 71 is fittable. As shown in FIG. 33, the guide slot 177 is shaped such that a curved portion 179 in the form of a substantially semicircle about the support shaft 65 symmetrically extends with respect to the forward and backward directions from the upper end of a vertically extending linear portion 78.

On the other hand, a pair of push-up pins 181 insertable into the insertion holes 75 from below project from the upper surface of the upper casing 3. Both slide bars 67 of the handle 40 are constantly biased by the elastic forces of the compression coil springs 173 so as to slide in a direction of insertion of the louver or fittable terminals 32*a*, 32*b* or of the movable electrode 31, in particular substantially downward in FIG. 31, and the movements thereof are restricted by the pins 168 coming into contact with the lower ends of the linear portions 78 of the guide slots 177. In this state, the bottom ends of the slide bars 67 project into the insertion holes 75. In this way, the handle 40 is uninclinably supported with respect to the mount body 35. When the fittable terminals 32*a*, 32*b* of the movable electrode 31 are inserted into the insertion holes 36 of the upper casing 3 by moving the handle 40, the push-up pins 181 enter the insertion holes 75, thereby pushing up the slide bars 67 against the elastic forces of the compression coil springs 173. When the fittable terminals 32*a*, 32*b* are pressed to be properly fitted to the corresponding fixed electrodes 11*a*, 11*b*, the pins 168 reach the upper ends of the linear portions 78 of the guide slots 177 while the bottom ends of the slide bars 67 come out of the insertion holes 75.

Since the other construction is similar to the fifth embodiment, no repetitive description is given thereon by identifying the same elements by the same reference numerals.

The sixth embodiment operates as follows. While the handle 40 is in its standing position, both slide bars 67 have their leading ends deeply inserted into the insertion holes 75 by being pressed by the elastic forces of the compression coil springs 173 as shown in FIGS. 31 and 33, and the pins 168 rest at the lower ends of the linear portions 78 of the guide slots 177. Accordingly, the handle 40 is uninclinably supported with respect to the mount body 35. Therefore, while the fittable terminals 32*a*, 32*b* of the movable electrode 31 projecting from the mount body 35 are being inserted into the insertion holes 36 of the upper casing 3, the mount body 35 or the movable electrode 31 does not wobble, enabling a smooth insertion.

When the fittable terminals 32*a*, 32*b* start fitting to the corresponding fixed electrodes 11*a*, 11*b* by the above insertion, the handle 40 may be inclined upon being subjected to a fitting resistance as in the fifth embodiment. During this insertion, the push-up pins 181 standing on the upper casing 3 enter the insertion holes 75 from below, thereby pushing up the slide bars 67 against the elastic forces of the compression coil springs 173. However, since the leading ends of the slide bars 67 are still in the insertion holes 75 and the pins 168 are located in the linear portions 78 of the guide slots 177, the handle 40 is still uninclinably held. Thus, the handle 40 is pressed in straight while being held in its standing position, with the result that the fittable terminals 32*a*, 32*b* are smoothly fitted to the fixed electrodes 11*a*, 11*b*.

When both fittable terminals 32*a*, 32*b* of the movable electrode 31 are properly fitted to the corresponding fixed electrodes 11*a*, 11*b*, the bottom ends of the slide bars 67 exit the insertion holes 75 upward and the pins 168 reach the upper ends of the linear portions 78 of the guide slots 177, i.e. the entrances to the curved portions 179. In this state, the handle 40 can be inclined or pivoted about the support shafts 65 while the pins 168 are relatively slid along the curved portions 179.

Further, in an insufficiently engaged state where the fittable terminals 32*a*, 32*b* of the movable electrode 31 are not properly engaged with the fixed electrodes 11*a*, 11*b*, the pins 168 are still in the linear portions 78 of the guide slots 177. Accordingly, the handle 40 cannot be inclined. The insufficiently engaged state can be detected in this manner. In such a case, the handle 40 is pressed again to its proper position.

The sixth embodiment has advantages similar to those of the fifth embodiments. Specifically, this embodiment is excellent in safety because of its construction in which the conductive path is located inside the casing 1 and is allowed to have a compact configuration of particularly low height while being in use because the handle 40 can be inclined to the resting position. Further, the operation can be smoothly performed since the handle 40 does not wobble while the movable electrode 31 is being inserted into the insertion holes 36 and is not inclinable while the movable electrode 31 is being fitted to the fixed electrodes 11*a*, 11*b*. Furthermore, the insufficiently engaged state can be detected.

In the sixth embodiment, the slide bars may be provided at the mount body while the guide slots may be provided at the handle. The invention is not limited to the breaker device where the fuse is provided at the side of the breaker switch, but also applicable to a breaker device singly including a breaker switch.

Figure 35:
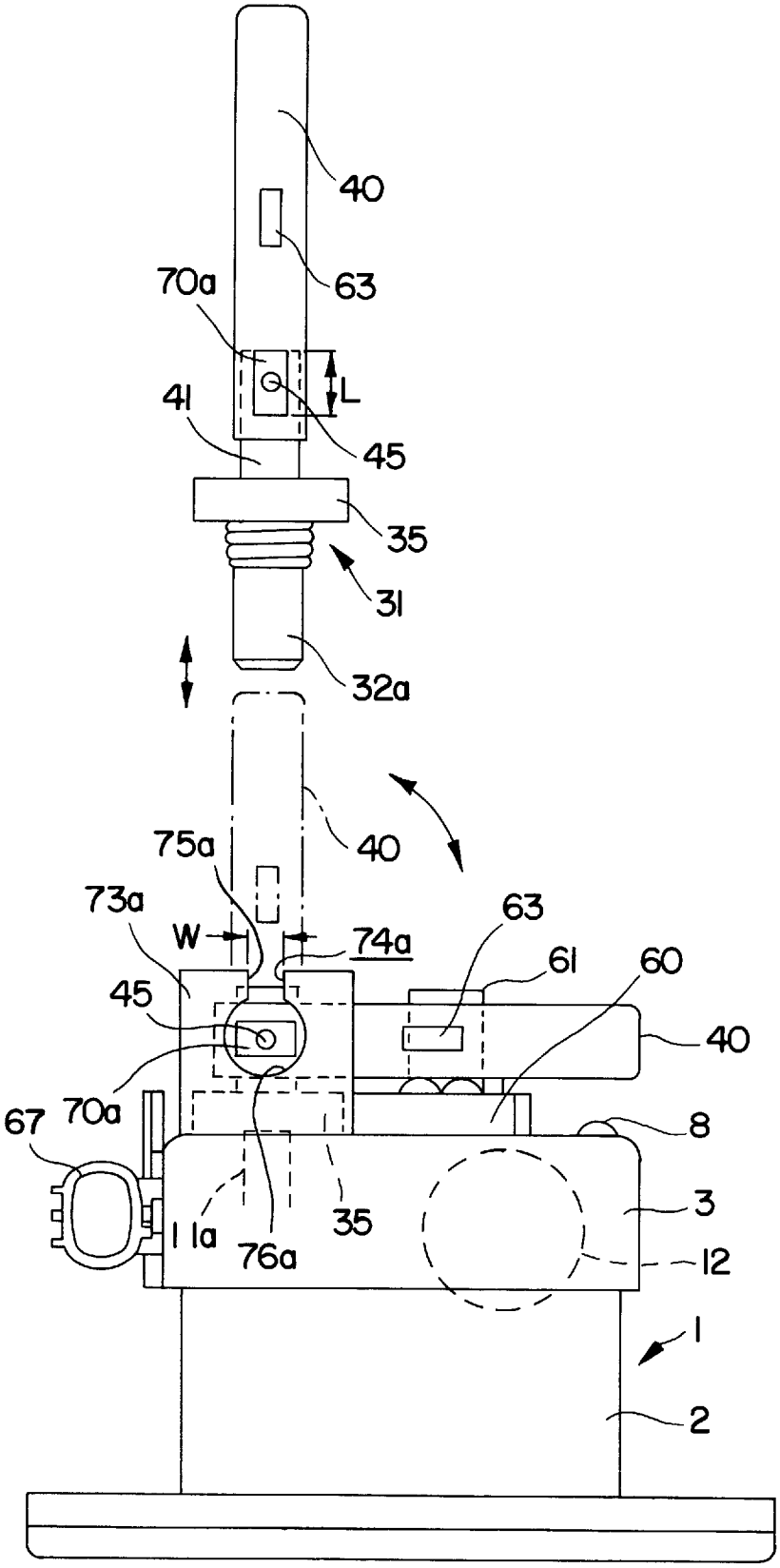
FIG. 35 is a side view showing how the handle is used for the engagement and disengagement of electrodes according to a seventh embodiment.

FIG. 35 shows a seventh embodiment of the invention. The elements of the seventh embodiment being the same or similar as those elements of the preceding embodiments are denoted with the same reference numerals and a detailed description thereof is omitted in the following.

In the seventh embodiment, slidable projections 70*a* are so formed as to extend long along the vertical direction when the handle 40 is in its standing position. On the other hand, a guide slot 74*a* formed in each guide column 73*a* includes a substantially linear portion 75*a* acting as a rotation preventing means in which the vertically oriented slidable projection 70*a* is so fitted or inserted that it is only free to make a sliding movement and a rotation permitting portion 76*a* for permitting the rotation of the slidable projection 70*a* about the support shaft 45. The length L of the slidable element 70*a* along a direction of insertion into the guide slot 74*a* is substantially greater than the width W of the guide slot 74*a* in a direction at an angle different from 0° or 180°, in particular substantially transverse or normal to the direction of insertion. Thus the slidable element 70*a* cannot be removed or disengaged from the guide slot 74*a*, in particular from the rotation permitting portion 76*a*, when the handle 40 is partially or fully inclined.

According to the seventh embodiment, during the insertion of the handle 40, the slidable projections 70*a* are fitted into the linear portions 75*a* of the guide slots 74*a*, thereby preventing the rotation of the handle 40. Accordingly, the handle 40 can be pressed in straight without wobbling. If the movable electrode 31 is properly engaged with the fixed electrodes 11*a*, 11*b*, the slidable projections 70*a* reach the rotation permitting portions 76*a* of the guide slots 74*a*, where the handle 40 is permitted to be inclined by permitting the rotation of the slidable projections 70*a* about the support shaft 45. Further, prior to the withdrawal of the handle 40, the slidable projections 70*a* can be positioned with respect to the linear portions 75*a* of the guide slots 74*a* with a small force.

Particularly, the seventh embodiment is constructed such that, when the handle 40 is inclined, the slidable projections 70*a* are horizontally oriented, thereby getting caught by the linear portions 75*a* of the guide slots 74*a*. This construction acts to prevent the handle 40 or the movable electrode 31 from being disengaged from the fixed electrodes 11*a*, 11*b*, in particular when the handle 40 is in its inclined position.

Figure 36A:
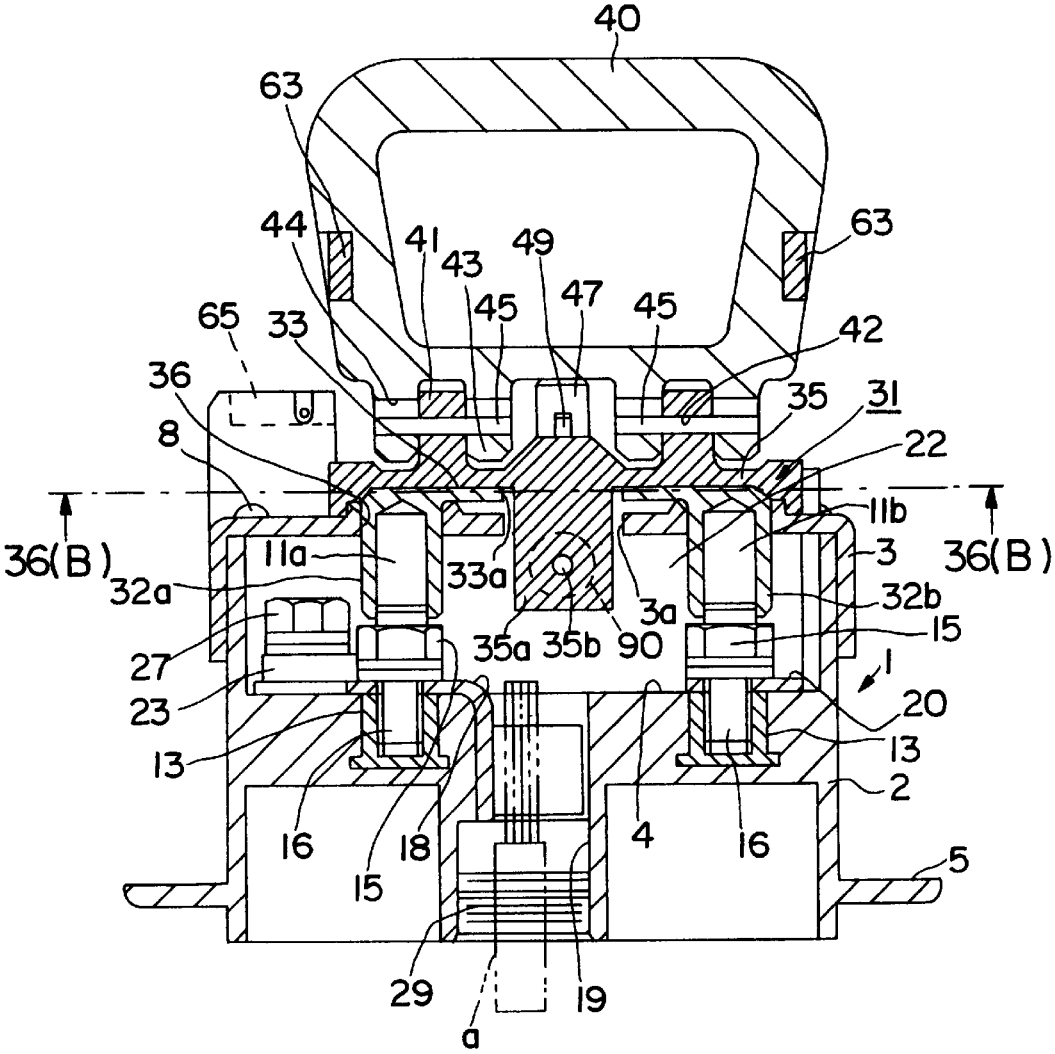
FIG. 36(A) is a vertical section of an eighth embodiment when the handle is in its standing position.
Figure 36B:
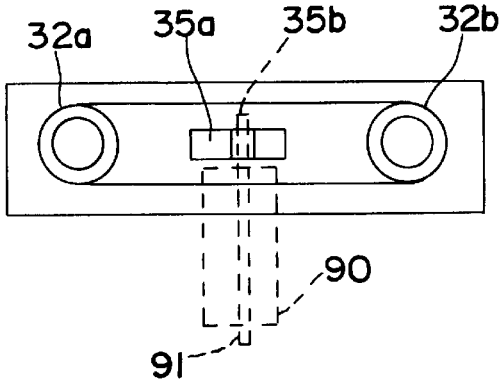
FIG. 36(B) is a sectional view along line 36(B)–36(B) of FIG. 36(A).

FIGS. 36(A) and 36(B) show an eighth embodiment of the invention. The elements of the eighth embodiment being the same or similar as those elements of the preceding embodiments, in particular the first embodiment, are denoted with the same reference numerals and a detailed description thereof is omitted in the following.

In the eighth embodiment the narrow mount body 35 of the movable electrode 31 is provided with a projection 35*a* acting as a securing portion, which preferably extends substantially in a direction of engagement of the movable electrode 31 with the fixed electrodes 11*a*, 11*b*. This projection 35*a* projects in the mounted or engaged state of the movable electrode 31 into the inner space of the upper casing 3 through an opening or hole 3*a* defined in the casing 3 and an opening 33*a* defined in the bridging member 33.

The projection 35*a* is provided with an opening or hole 35*b*, which extends in a direction at an angle different from 0° or 180° with respect to the engagement direction of the movable electrode 31, preferably substantially normal thereto. A disengagement preventing means 90 is provided e.g. inside the upper casing 3 and comprises a pin 91 being insertable into the hole 35*b*. The disengagement preventing means 90 (e.g. an electromechanic element as a solenoid 90 having a ferromagnetic pin 91) pre vent s disengagement of the movable electrode 31 by preventing the projection 35*a* from being removed from the upper casing 3 when a current is flowing in the fixed electrodes 11*a*, 11*b* and/or through the movable electrode 31. When a current is flowing (or a voltage is applied to the fixed electrodes 11*a*, 11*b*) the pin 91 of the disengagement preventing means 90 is extended and projects into the hole 35*b*, thereby preventing the removal of the projection 35*a*, i.e. locking or securing the projection to the upper casing 3. When the current flowing through the fixed electrodes 11*a*, 11*b* (or the voltage applied thereto) is interrupted, the pin 91 retracts from the hole 35*b* thereby allowing a removal of the projection 35*a* from the inner space of the upper casing 3, i.e. thereby allowing a disengagement of the movable electrode 31 from the fixed electrodes 11*a*, 11*b*.

According to a modification of the eighth embodiment, the disengagement preventing means comprises a pin being insertable into the rotation permitting portion 76*a* e.g. according to the seventh embodiment, thereby preventing a pivotal movement of the handle 40 e.g. from its reclined position, whereby the movable electrode 31 is not disengageable from the fixed electrodes 11*a*, 11*b*.

According to a further modification of the eighth embodiment the handle 40 is hold by a hook being preferably electromechanically actuated, which blocks the handle when a current is flowing, thereby preventing the handle 40 to be actuated for disengaging or removing the movable electrode 31 from the fixed electrodes 11*a*, 11*b*. Preferably the hook is biased by a spring toward its non-blocking position and is electromechanically moved to a position, where it blocks the handle (or hinders the handle to be actuated), when a current is flowing. Alternatively the hook can act directly on the movable electrode 31, e.g. at its bridging portion 33.

Thus also in case a current interrupting means (e.g. the lead switch 65) for interrupting the current flowing through the fixed/movable electrodes has failed, a disengagement of the movable electrode can be prevented by the disengagement preventing means, thereby enhancing the security of the system.

In a further preferred embodiment of the invention, the resistance to disengage the louver or fittable terminals 32*a*, 32*b* from the fixed electrodes 11*a*, 11*b* is enlarged such that only a fast disengagement of the movable electrode 31 is possible.

The present invention is not limited to the foregoing embodiments described above and shown in the drawings. For example, the following embodiments are embraced by the technical scope of the present invention as defined in the claims, and a variety of other changes are possible without departing from the spirit and scope of the present invention as defined in the claims, besides the following embodiments.

What is claimed is:

1. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), and a handle (40) provided at and movable with the movable electrode means (32*a*, 32*b*, 33) for the engagement and disengagement of the movable electrode means (32*a*, 32*b*, 33), said handle (40) being biased toward at least one position by a toggle mechanism including a spring member (47; 47*a*), the handle (40) comprising at least one contact surface (58) interacting with the spring member (47; 47*a*), the spring member (47; 47*a*) being substantially made of a resilient plate and having at least one linear portion (53*a*; 53*b*) corresponding to at least one position of the handle (40).

2. A breaker device according to claim 1, wherein the handle (40) is pivotable between a resting position and a standing position arranged at an angle different from 0° or 180°.

3. A breaker device according to claim 1, wherein the movable electrode means (32*a*, 32*b*, 33) comprises at least two fittable terminals (32*a*, 32*b*) being fittable with the fixed electrodes (11*a*, 11*b*).

4. A breaker device according to claim 1, further comprising an electronic device (12) connected with the breaker switch (38).

5. A breaker device according to claim 4, wherein the electronic device is a fuse.

6. A breaker device according to claim 4, further comprising a casing (1), the pair of fixed electrodes (11*a*, 11*b*) being placed substantially upright at one side of the casing (1), and wherein the electronic device (12) is accommodated in a remaining space of the casing (1).

7. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), and a handle (40) provided at and movable with the movable electrode means (32*a*, 32*b*, 33) for the engagement and disengagement of the movable electrode means (32*a*, 32*b*, 33), the handle (40) being biased toward at least one position by a toggle mechanism including a spring member (47; 47*a*), the handle (40) comprising at least one contact surface interacting in sliding contact with a surface of the movable electrode means (32*a*, 32*b*, 33), and wherein the spring member comprises a spring biasing the handle (40) toward the movable electrode means (32*a*, 32*b*, 33), wherein the at least one contact surface of the handle (40) corresponds to the at least one position of the handle (40).

8. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at the movable electrode means (32*a*, 32*b*, 33) for the engagement and disengagement of the movable electrode means (32*a*, 32*b*, 33), and an engagement detection means (63; 65) including a switch (65), for detecting whether the breaker switch (38) is correctly engaged and for producing a detection control signal.

9. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at the movable electrode means (32*a*, 32*b*, 33) for the engagement and disengagement of the movable electrode means (32*a*, 32*b*, 33), and a slidable element (70; 70*a*; 80) and a guide slot (74; 84) provided between the handle (40) and the casing (1), the guide slot (74; 84) being adapted to guide a relative sliding movement of the slidable element (70; 70*a*; 80) as the handle (40) is operated to engage and disengage the movable electrode (31) with and from the fixed electrodes (11*a*, 11*b*).

10. A breaker device according to claim 9, wherein an inclination permitting portion (75; 85) is formed at the guide slot (74; 84) for permitting the handle (40) to be pivoted by permitting relative displacement of the slidable element (70; 70*a*; 80) upon the completion of the proper engagement of the movable electrode (31) with the fixed electrodes (11*a*, 11*b*).

11. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at and movable with the movable electrode means (32*a*, 32*b*, 33) for the engagement and disengagement of the movable electrode means (32*a*, 32*b*, 33), and a slidable element (70; 70*a*; 80) being provided at the handle (40) and being distanced from an axis of inclination (45) of the handle (40), a length (L) of the slidable element (70*a*) along a direction of insertion of the slidable element (70*a*) into the guide slot (74*a*) being substantially larger than a width (W) of the guide slot (74*a*) in a direction at an angle different from 0° or 180° with respect to the direction of insertion of the slidable element (70*a*) and along a direction of inclination of the handle (40) in its resting position.

12. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at and movable with the movable electrode means (32*a*, 32*b*, 33) for the engagement and disengagement of the movable electrode means (32*a*, 32*b*, 33), and a movable member (146*a*; 168) provided between the handle (40) and the movable electrode (31) and being movable between an inclination prohibiting position where the movable member (146*a*; 168) uninclinably locks the handle (40) and an inclination permitting position where the movable member (146*a*; 168) permits the inclination of the handle (40).

13. A breaker device according to claim 12, further comprising a biasing member (148; 173) for constantly biasing the movable member (146*a*; 168) toward the inclination prohibiting position.

14. A breaker device according to claim 13, further comprising a casing (1) substantially surrounding the fixed electrodes (11*a*, 11*b*), an operable member (150; 181) provided at the casing (1) for coming into engagement with the movable member (146*a*; 168) while the movable electrode (31) is being engaged and for moving the movable member (31) to the inclination permitting position when the movable electrode (31) is engaged with the fixed electrodes (11*a*, 11*b*).

15. A breaker device according to claim 14, wherein the handle (40) is inclinably supported with respect to at least two shafts (146*a*, 146*b*) which are substantially coaxially alignable, one shaft (146*a*) being displaceable between a displacement position where the axis thereof is displaced from that of the other shaft (146*b*) and an alignment position where the axis thereof is aligned with that of the other shaft (146*b*), and being biased toward the displacement position by the biasing member (148), the operable member (150) being disposed for engagement with the one shaft (164*a*) while the movable electrode (31) is being engaged, and for moving the one shaft (146*a*) to the alignment position when the movable electrode (31) is properly engaged with the fixed electrodes (11*a*, 11*b*).

16. A breaker device according to claim 14, wherein a slidable element (168) and a guide slot (177) for guiding only a relative sliding movement of the slidable element (168) are provided between the handle (40) and the movable electrode (31), the guide slot (177) being formed with an inclination permitting portion (179) for permitting the inclination of the handle (40) by permitting a relative displacement of the slidable element (168), and the slidable element (168) being constantly biased toward a position spaced apart from the inclination permitting portion (179) by a biasing member (173), and the casing (1) being provided with an operable member (181) for coming into engagement with the slidable element (168) while the movable electrode (31) is being engaged, and for moving the slidable element (168) to the position of the inclination permitting portion (179) of the guide slot (177) when the movable electrode (31) is properly engaged with the fixed electrodes (11*a*).

17. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at the movable electrode means (32*a*, 32*b*, 33) for the engagement and disengagement of the movable electrode means (32*a*, 32*b*, 33), and a current interrupting means (65) for interrupting the current flowing to the fixed electrodes (11*a*, 11*b*) before the movable electrode (31) is disengaged in any position of the handle (40) except its resting position.

18. A breaker device, comprising:

a pair of fixed electrodes (11*a*, 11*b*), a movable electrode means (32*a*, 32*b*, 33) engageable with and disengageable from the fixed electrodes (11*a*, 11*b*) for connecting and disconnecting the fixed electrodes (11*a*, 11*b*), thereby forming a breaker switch (38) together with the fixed electrodes (11*a*, 11*b*), a handle (40) provided at the movable electrode means (32*a*, 32*b*, 33) for the engagement and disengagement of the movable electrode means (32*a*, 32*b*, 33), and a disengagement preventing means (35*a*, 35*b*; 90, 91) for preventing a disengagement of the movable electrode (31) from the fixed electrodes (11*a*, 11*b*) in response to the movement of the handle when there is either a current flowing to the fixed electrodes (11*a*, 11*b*) or a voltage applied thereto.

* * * * *